US008348820B2

(12) United States Patent
Costanzo, Jr. et al.

(10) Patent No.: US 8,348,820 B2
(45) **Date of Patent: *Jan. 8, 2013**

(54) APPARATUS AND METHODS RELATING TO CORRUGATED MATERIALS, CONTAINERS, AND PACKAGING

(75) Inventors: Donn J. Costanzo, Jr., Fort Mill, SC (US); Donn J. Costanzo, Tega Cay, SC (US)

(73) Assignee: Thatbox Design, LLC, Fort Mill, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/465,030

(22) Filed: May 7, 2012

(65) Prior Publication Data

US 2012/0238424 A1 Sep. 20, 2012

Related U.S. Application Data

(63) Continuation of application No. 13/049,890, filed on Mar. 16, 2011.

(60) Provisional application No. 61/452,640, filed on Mar. 14, 2011.

(51) Int. Cl.
*B31B 1/62* (2006.01)

(52) U.S. Cl. ..... 493/128; 493/162; 493/185; 493/311

(58) Field of Classification Search ..... 493/128, 493/162, 167, 175, 185, 311, 317
See application file for complete search history.

(56) References Cited

U.S. PATENT DOCUMENTS

| | | | | |
|---|---|---|---|---|
| 662,619 | A | 11/1900 | Foltz | |
| 1,075,844 | A | 10/1913 | Miller | |
| 1,190,797 | A | 7/1916 | Powell | |
| 2,017,129 | A | 10/1935 | Osterberg | |
| 2,019,995 | A | 11/1935 | Rippen | |
| 2,512,382 | A * | 6/1950 | Ringler | 493/136 |

(Continued)

FOREIGN PATENT DOCUMENTS

EP 337280 A1 10/1989

(Continued)

OTHER PUBLICATIONS

Information Disclosure Statement (IDS) Letter Regarding Common Patent Application(s), dated, Jul. 30, 2012.

(Continued)

*Primary Examiner* — Hemant M Desai
(74) *Attorney, Agent, or Firm* — Tillman Wright, PLLC; Chad D. Tillman; Jeremy C. Doerre

(57) ABSTRACT

A machine for transitioning a box cutout from a flat configuration to a collapsed box configuration includes a first drive wheel configured to drive a box cutout towards a plunging area; a plunger configured to apply force to a central portion of a bottom panel of the box cutout so as to fold the box about a lateral bisecting axis and propel at least a portion of the box cutout downward; and opposed second and third drive wheels configured to grab a box cutout propelled downward by the plunger and further draw the box cutout downward into a collapsed box configuration within a collection area. A box cutout transitioned to a collapsed box configuration in this manner may include a bottom panel having plurality of unbroken minor score lines and broken major score lines.

20 Claims, 35 Drawing Sheets

U.S. PATENT DOCUMENTS

| | | | | | |
|---|---|---|---|---|---|
| 2,532,479 | A | * | 12/1950 | Burgess | 493/126 |
| 3,119,547 | A | * | 1/1964 | Nute | 229/117.06 |
| 3,154,052 | A | | 10/1964 | Sweeney | |
| 3,199,762 | A | | 8/1965 | Coons | |
| 3,309,970 | A | * | 3/1967 | Pierce | 493/311 |
| 4,006,670 | A | * | 2/1977 | Royal | 493/10 |
| 4,068,795 | A | | 1/1978 | Forster | |
| 4,119,265 | A | | 10/1978 | Dlugopolski | |
| 4,341,341 | A | | 7/1982 | Roccaforte | |
| 4,890,576 | A | | 1/1990 | James | |
| 4,979,669 | A | | 12/1990 | Kerton | |
| 5,020,337 | A | | 6/1991 | Krieg | |
| 5,062,527 | A | | 11/1991 | Westerman | |
| 5,094,359 | A | | 3/1992 | DeMars et al. | |
| 5,284,294 | A | | 2/1994 | Floyd | |
| 5,303,863 | A | | 4/1994 | Arasim | |
| 5,307,986 | A | | 5/1994 | Schuster | |
| 5,562,228 | A | | 10/1996 | Ericson | |
| 6,164,526 | A | | 12/2000 | Dalvey | |
| 6,736,309 | B1 | | 5/2004 | Westerman et al. | |
| 6,837,420 | B2 | | 1/2005 | Westerman et al. | |
| 7,841,512 | B2 | | 11/2010 | Westerman et al. | |
| 7,870,995 | B1 | | 1/2011 | Kaltman et al. | |
| 2008/0290149 | A1 | | 11/2008 | Sweet | |
| 2012/0234715 | A1 | | 9/2012 | Costanzo | |
| 2012/0234846 | A1 | | 9/2012 | Costanzo | |
| 2012/0234903 | A1 | | 9/2012 | Costanzo | |
| 2012/0234904 | A1 | | 9/2012 | Costanzo | |
| 2012/0238423 | A1 | | 9/2012 | Costanzo | |
| 2012/0238425 | A1 | | 9/2012 | Costanzo | |

FOREIGN PATENT DOCUMENTS

| | | | |
|---|---|---|---|
| WO | 9611848 | A1 | 4/1996 |

OTHER PUBLICATIONS

Canadian Application No. 2,201,965, Jul. 30, 2012.

U.S. Appl. No. 13/049,890 filed Mar. 16, 2011, having Donn J. Costanzo Jr. as the first named inventor, pending, and docketed.

U.S. Appl. No. 13/465,033 filed May 5, 2012, having Donn J. Costanzo Jr. as the first named inventor, pending, and docketed.

U.S. Appl. No. 13/465,031 filed May 7, 2012, having Donn J. Costanzo Jr. as the first named inventor, pending, and docketed.

U.S. Appl. No. 13/465,032 filed May 7, 2012, having Donn J. Costanzo Jr. as the first named inventor, pending, and docketed.

U.S. Appl. No. 13/194,999 filed Jul. 31, 2011, having Donn J. Costanzo Jr. as the first named inventor, pending, and docketed.

U.S. Appl. No. 13/420,411 filed Mar. 14, 2012, having having Donn J. Costanzo Jr. as the first named inventor, pending, and awaiting docketing.

U.S. Appl. No. 13/420,411 filed Mar. 14, 2012, having Donn J. Costanzo Jr. as the first named inventor, pending, and docketed.

U.S. Appl. No. 13/462,799 filed May 2, 2012, having Donn J. Costanzo Jr. as the first named inventor, pending, and awaiting docketing.

* cited by examiner

10

10

10

10

10

10

10

10

110

110

310

APPARATUS AND METHODS RELATING TO CORRUGATED MATERIALS, CONTAINERS, AND PACKAGING

CROSS-REFERENCE TO RELATED APPLICATION

The present application is a U.S. continuation patent application of, and claims priority under 35 U.S.C. §120 to, U.S. nonprovisional patent application Ser. No. 13/049,890, filed Mar. 16, 2011, which '890 application is incorporated herein by reference, and which '890 application is a nonprovisional patent application of, and claims priority under 35 U.S.C. §119(e) to, U.S. provisional patent application Ser. No. 61/452,640, filed Mar. 14, 2011, which '640 application is incorporated herein by reference. Additionally, any publication of the '890 application and any patent issuing therefrom is hereby incorporated herein by reference. Moreover, the present application hereby incorporates by reference the Appendix hereto, which includes the priority provisional disclosure including Exhibits A and C of the appendix of such provisional. The innovations disclosed in the Appendix hereto and incorporated herein by reference are considered innovations of the disclosure of the present application.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally pertains to apparatus and methods relating to corrugated materials, containers and packaging.

Patents illustrative of the background of the invention include, for example, U.S. Pat. Nos. 5,062,527; 5,094,359; 5,263,339; 5,284,294; 5,582,343; 6,164,526; 6,736,309; 6,837,420; and 7,841,512.

It is believed that a need exists for improvement in apparatus and methods relating to corrugated materials, containers and packaging. This, and other needs, are addressed by one or more aspects and features of the present invention.

SUMMARY OF THE INVENTION

The present invention includes many aspects and features. Moreover, while many aspects and features relate to, and are described in, the context apparatus and methods relating to corrugated materials, containers and packaging, the present invention is not necessarily limited to use only in such apparatus and methods, as will become apparent from the following summaries and detailed descriptions of aspects, features, and one or more embodiments of the present invention.

Accordingly, an aspect of the present invention relates to a machine configured to transition a box cutout from a flat configuration to a collapsed configuration. The machine includes one or more drive wheels configured to drive a box cutout towards a plunging area; one or more freely rotating wheels, each freely rotating wheel being disposed directly above one of the one or more first drive wheels; one or more glue applicators configured to apply glue to a box cutout; a first detector configured to detect the presence of a box cutout and trigger application of glue thereto; a backstop configured to halt movement of a box cutout in the plunging area; one or more rotational fingers configured to effect folding of a box cutout disposed in the plunging area; one or more clamps configured to hold a box cutout in position during folding by the one or more rotational fingers; a plunger located in the plunging area configured to apply force to a central portion of a box cutout disposed below the plunger so as to effect at least partial collapsing of such box cutout and downward movement of such box cutout; a second detector configured to detect the presence of a box cutout and trigger folding thereof by the one or more rotational fingers and plunging thereof by the plunger; one or more guide wheels located below the plunging area, the guide wheels being configured to engage a box cutout being plunged by the plunger; opposed grab wheels located below the one or more guide wheels, the grab wheels being configured to engage a box cutout that has been plunged downward by the plunger, facilitate collapse of such box cutout, and propel such box cutout further downward; and a collector configured to collect a box cutout propelled downward by the grab wheels and place such collected box cutout in a collection pen. The backstop and one of the drive wheels are each positioned relative to the plunger based on dimensions of a particular box cutout, and a length of a plunging head of the plunger corresponds to the length of a portion of a score line of the particular box cutout.

In a feature of this aspect, the machine further includes a third detector configured to detect plunging of the plunger, and wherein the collector is configured to, based on a count of plunges detected by the third detector, elevate a particular collected box cutout when placing that particular collected box cutout in the collection pen.

In a feature of this aspect, the one or more drive wheels comprise two drive wheels.

In a feature of this aspect, the one or more guide wheels comprise two opposed sets of two guide wheels.

In a feature of this aspect, the grab wheels are configured to press together opposite sides of a box cutout passing therebetween.

In a feature of this aspect, the machine further includes a cutout receiving area configured to receive a plurality of box cutouts for processing by the machine.

In a feature of this aspect, the one or more glue applicators include one or more first glue applicators configured to apply glue to a top side of a box cutout and one or more second glue applicators configured to apply glue to a bottom side of a box cutout.

In a feature of this aspect, each detector comprises a laser detector.

In a feature of this aspect, the plunging head of the plunger has a blunt end.

In a feature of this aspect, the plunging head of the plunger is tapered.

In a feature of this aspect, the plunging head of the plunger has a planar face configured to engage a box cutout.

In a feature of this aspect, the plunging head of the plunger has a curved face configured to engage a box cutout.

In a feature of this aspect, the plunging head of the plunger is configured to be removable and interchangeable with other plunging heads.

In a feature of this aspect, the machine further includes a deflector disposed adjacent the plunger, the deflector being shaped and positioned to deflect a box cutout downward in the event that such a box cutout has drifted upward.

In a feature of this aspect, a position of the backstop is adjustable.

In a feature of this aspect, a position of at least one of the drive wheels is adjustable.

In a feature of this aspect, a position of each of the one or more glue applicators is adjustable.

In a feature of this aspect, a position of each of the one or more guide wheels is adjustable.

In a feature of this aspect, a distance the plunger plunges is adjustable.

In a feature of this aspect, a position of each of the one or more rotational fingers is adjustable.

Another aspect of the present invention relates to a machine configured to transition a box cutout from a flat configuration to a collapsed configuration. The machine includes a backstop configured to halt forward movement of a box cutout in a plunging area; one or more rotational fingers configured to effect folding of a box cutout disposed in the plunging area; a plunger configured to apply force to a central portion of a box cutout disposed below the plunger so as to effect at least partial collapsing of that box cutout and downward movement of that box cutout, the plunger comprising a plunging head configured to engage such a box cutout; a detector configured to detect the presence of a box cutout and trigger folding thereof by the one or more rotational fingers and plunging thereof by the plunger; and opposed grab wheels located below the plunging area, the grab wheels being configured to engage a box cutout that has been plunged downward by the plunger, facilitate collapse of such box cutout, and propel such box cutout further downward. The backstop is positioned relative to the plunger based on dimensions of a particular box cutout, and a length of the plunging head of the plunger corresponds to the length of a portion of a score line of the particular box cutout.

Another aspect of the present invention relates to a method of transitioning a box cutout from a flat configuration to a collapsed configuration via a machine. The method includes driving, via one or more drive wheels, a box cutout toward a plunging area; detecting, via a first detector, the presence of the box cutout; applying, via one or more glue applicators, glue to the box cutout; facilitating halting, via a backstop, the movement of the box cutout when it is located within the plunging area; detecting, via a second detector, the presence of the box cutout; holding the box cutout in position with one or more clamps; in response to the step of detecting, via the second detector, the presence of the box cutout, folding, via one or more rotational fingers, the box cutout; after the step of folding the box cutout, applying downward force, via a plunger, to a central portion of the box cutout disposed below the plunger so as to effect at least partial collapsing of the box cutout and downward movement of the box cutout; guiding, via one or more guide wheels located below the plunging area, the descent of the box cutout as the box cutout is being plunged by the plunger; engaging, via opposed grab wheels located below the one or more guide wheels, the box cutout that has been plunged downward by the plunger, the opposed grab wheels pressing opposite sides of the box cutout together and propelling the box cutout in a downward direction; and effecting placement, using a collector, of the box cutout in a collection pen.

In a feature of this aspect, the backstop and one of the drive wheels are each positioned relative to the plunger based on dimensions of a particular box cutout.

In a feature of this aspect, a width of a plunging head of the plunger corresponds to the length of a portion of a score line of a particular box cutout.

In a feature of this aspect, the method further includes a step of deflecting, using a deflector adjacent the plunger, the box cutout downward.

In a feature of this aspect, the method further includes a step of detecting, via a third detector, plunging of the plunger, and wherein the collector is configured to, based on a count of plunges detected by the third detector, elevate the particular collected box cutout when effecting placement of the collected box cutout in the collection pen.

In a feature of this aspect, the one or more drive wheels comprise two drive wheels.

In a feature of this aspect, the one or more guide wheels comprise two opposed sets of two guide wheels.

In a feature of this aspect, the method further includes a step of dropping the cutout down from a cutout receiving area in which the cutout was received, the cutout receiving area being configured to receive a plurality of box cutouts for processing.

In a feature of this aspect, the method further includes a step of removing a plunging head of the plunger and replacing it with a different plunging head.

Another aspect of the present invention relates to a method of transitioning a box cutout from a flat configuration to a collapsed configuration via a machine. The method includes facilitating halting, via a backstop, movement of a box cutout when it is located within a plunging area; detecting, via a second detector, the presence of the box cutout; holding the box cutout in position with one or more clamps; folding, via one or more rotational fingers, the box cutout; applying downward force, via a plunger, to a central portion of the box cutout disposed below the plunger so as to effect at least partial collapsing of the box cutout and downward movement of the box cutout; guiding, via one or more guide wheels located below the plunging area, the descent of the box cutout as the box cutout is being plunged by the plunger; and engaging, via opposed grab wheels located below the one or more guide wheels, the box cutout that has been plunged downward by the plunger, the opposed grab wheels pressing opposite sides of the box cutout together and propelling the box cutout in a downward direction.

Another aspect of the present invention relates to a machine configured to transition a box cutout from a flat configuration to a collapsed configuration. The machine includes one or more drive wheels configured to drive a box cutout towards a plunging area; one or more freely rotating wheels, each freely rotating wheel being disposed directly above one of the one or more first drive wheels; one or more glue applicators configured to apply glue to a box cutout; a first detector configured to detect the presence of a box cutout and trigger application of glue thereto; a backstop configured to halt movement of a box cutout in the plunging area; a plunger located in the plunging area configured to apply force to a central portion of a box cutout disposed below the plunger so as to effect downward movement of such a box cutout; a second detector configured to detect the presence of a box cutout and trigger plunging thereof by the plunger; one or more structures positioned and configured to effect at least partial folding of a box cutout being plunged by the plunger; one or more guide wheels located below the plunging area, the guide wheels being configured to guide a box cutout being plunged by the plunger; opposed grab wheels located below the one or more guide wheels, the grab wheels being configured to engage a box cutout that has been plunged downward by the plunger, facilitate collapse of such box cutout, and propel such box cutout further downward; and a collector configured to collect a box cutout propelled downward by the grab wheels and place such collected box cutout in a collection pen. The backstop and one of the drive wheels are each positioned relative to the plunger based on dimensions of a particular box cutout; and a length of a plunging head of the plunger corresponds to the length of a portion of a score line of the particular box cutout.

In a feature of this aspect, the machine further includes a deflector disposed adjacent the plunger, the deflector being shaped and positioned to deflect a box cutout downward in the event that such a box cutout has drifted upward.

In a feature of this aspect, the one or more structures comprise one or more fingers.

In a feature of this aspect, the one or more structures comprise one or more fingers, and the one or more fingers are adjustable in at least one plane.

In a feature of this aspect, the one or more structures comprise one or more fingers, and at least some of the fingers are fixed at a forty five degree angle relative to vertical In a feature of this aspect, the one or more structures comprise one or more fingers, and at least some of the fingers are fixed at a forty five degree angle relative to the direction the one or more drive wheels drive box cutouts.

In a feature of this aspect, the one or more structures comprise one or more fingers, and an angle of the fingers relative to vertical is adjustable.

In a feature of this aspect, the one or more structures comprise one or more fingers, and an angle of the fingers relative to the direction the one or more drive wheels drive box cutouts is adjustable.

In a feature of this aspect, the one or more structures comprise one or more fingers, and the one or more fingers are adjustable through two or more planes.

In a feature of this aspect, a position of each of the one or more structures is adjustable.

In a feature of this aspect, the machine further includes a third detector configured to detect plunging of the plunger, and wherein the collector is configured to, based on a count of plunges detected by the third detector, elevate a particular collected box cutout when placing that particular collected box cutout in the collection pen.

In a feature of this aspect, the one or more drive wheels comprise two drive wheels.

In a feature of this aspect, the one or more guide wheels comprise two opposed sets of two guide wheels.

In a feature of this aspect, the grab wheels are configured to press together opposite sides of a box cutout passing therebetween.

In a feature of this aspect, the machine further includes a cutout receiving area configured to receive a plurality of box cutouts for processing by the machine.

In a feature of this aspect, the one or more glue applicators include one or more first glue applicators configured to apply glue to a top side of a box cutout and one or more second glue applicators configured to apply glue to a bottom side of a box cutout.

In a feature of this aspect, each detector comprises a laser detector.

In a feature of this aspect, the plunging head of the plunger has a blunt end.

In a feature of this aspect, the plunging head of the plunger is tapered.

In a feature of this aspect, the plunging head of the plunger has a planar face configured to engage a box cutout.

In a feature of this aspect, the plunging head of the plunger has a curved face configured to engage a box cutout.

In a feature of this aspect, the plunging head of the plunger is configured to be removable and interchangeable with other plunging heads.

In a feature of this aspect, a position of the backstop is adjustable.

In a feature of this aspect, a position of at least one of the drive wheels is adjustable.

In a feature of this aspect, a position of each of the one or more glue applicators is adjustable.

In a feature of this aspect, a position of each of the one or more guide wheels is adjustable.

In a feature of this aspect, a distance the plunger plunges is adjustable.

Another aspect of the present invention relates to a machine configured to transition a box cutout from a flat configuration to a collapsed configuration. The machine includes a backstop configured to halt forward movement of a box cutout in a plunging area; a plunger located in the plunging area configured to apply force to a central portion of a box cutout disposed below the plunger so as to effect downward movement of such a box cutout; a detector configured to detect the presence of a box cutout and trigger plunging thereof by the plunger; one or more structures positioned and configured to effect at least partial folding of a box cutout being plunged by the plunger; opposed grab wheels located below the plunging area, the grab wheels being configured to engage a box cutout that has been plunged downward by the plunger, facilitate collapse of such box cutout, and propel such box cutout further downward; and wherein the backstop is positioned relative to the plunger based on dimensions of a particular box cutout; and wherein a length of the plunging head of the plunger corresponds to the length of a portion of a score line of the particular box cutout.

Another aspect of the present invention relates to a method of transitioning a box cutout from a flat configuration to a collapsed configuration via a machine. The method includes driving, via one or more drive wheels, a box cutout toward a plunging area; detecting, via a first detector, the presence of the box cutout; applying, via one or more glue applicators, glue to the box cutout; facilitating halting, via a backstop, the movement of the box cutout when it is located within the plunging area; detecting, via a second detector, the presence of the box cutout; in response to the step of detecting, via the second detector, the presence of the box cutout, applying downward force, via a plunger, to a central portion of the box cutout disposed below the plunger so as to effect at least partial collapsing of the box cutout and downward movement of the box cutout, the partial collapse being facilitated by one or more structures positioned and configured to effect at least partial folding of a box cutout being plunged by the plunger; guiding, via one or more guide wheels located below the plunging area, the descent of the box cutout as the box cutout is being plunged by the plunger; engaging, via opposed grab wheels located below the one or more guide wheels, the box cutout that has been plunged downward by the plunger, the opposed grab wheels pressing opposite sides of the box cutout together and propelling the box cutout in a downward direction; and effecting placement, using a collector, of the box cutout in a collection pen.

In a feature of this aspect, the one or more structures comprise one or more fingers.

In a feature of this aspect, the one or more structures comprise one or more fingers, and the method further includes a step of adjusting an angle of one or more of the one or more fingers.

In a feature of this aspect, the one or more structures comprise one or more fingers, and the one or more fingers are fixed at a forty five degree angle relative to vertical.

In a feature of this aspect, the one or more structures comprise one or more fingers, and at least some of the fingers are fixed at a forty five degree angle relative to the direction the one or more drive wheels drive box cutouts.

In a feature of this aspect, the method further includes a step of adjusting a position of one of the one or more structures.

Another aspect of the present invention relates to a method of transitioning a box cutout from a flat configuration to a collapsed configuration via a machine. The method includes facilitating halting, via a backstop, movement of a box cutout when it is located within a plunging area; detecting, via a second detector, the presence of the box cutout; in response to the step of detecting, via the second detector, the presence of the box cutout, applying downward force, via a plunger, to a central portion of the box cutout disposed below the plunger so as to effect at least partial collapsing of the box cutout and downward movement of the box cutout, the partial collapse being facilitated by one or more structures positioned and configured to effect at least partial folding of a box cutout being plunged by the plunger; and engaging, via opposed grab wheels located below the plunging area, the box cutout that has been plunged downward by the plunger, the opposed grab wheels pressing opposite sides of the box cutout together and propelling the box cutout in a downward direction.

Another aspect of the present invention relates to a machine configured to transition a box cutout from a flat configuration to a collapsed configuration. The machine includes a backstop configured to halt forward movement of a box cutout in a plunging area; a plunger located in the plunging area configured to apply force to a central portion of a box cutout disposed below the plunger so as to effect downward movement of such a box cutout; a detector configured to detect the presence of a box cutout and trigger plunging thereof by the plunger; and opposed grab wheels located below the plunging area, the grab wheels being configured to engage a box cutout that has been plunged downward by the plunger, facilitate collapse of such box cutout, and propel such box cutout further downward. The backstop is positioned relative to the plunger based on dimensions of a particular box cutout, and a length of the plunging head of the plunger corresponds to the length of a portion of a score line of the particular box cutout.

Another aspect of the present invention relates to a method of transitioning a box cutout from a flat configuration to a collapsed configuration via a machine. The method includes facilitating halting, via a backstop, movement of a box cutout when it is located within a plunging area; detecting, via a second detector, the presence of the box cutout; in response to the step of detecting, via the second detector, the presence of the box cutout, applying downward force, via a plunger, to a central portion of the box cutout disposed below the plunger so as to effect at least partial collapsing of the box cutout and downward movement of the box cutout; and engaging, via opposed grab wheels located below the plunging area, the box cutout that has been plunged downward by the plunger, the opposed grab wheels pressing opposite sides of the box cutout together and propelling the box cutout in a downward direction.

Another aspect of the present invention relates to a machine configured to transition a box cutout from a flat configuration to a collapsed configuration. The machine includes a backstop configured to halt forward movement of a box cutout in a plunging area; a plunger located in the plunging area configured to apply force to a central portion of a box cutout disposed below the plunger so as to effect downward movement of such a box cutout; a detector configured to detect the presence of a box cutout and trigger plunging thereof by the plunger; and opposed grab wheels located below the plunging area, the grab wheels being configured to engage a box cutout that has been plunged downward by the plunger, facilitate collapse of such box cutout, and propel such box cutout further downward.

Another aspect of the present invention relates to a box cutout. The box cutout includes a bottom panel; a score line bisecting the bottom panel; plurality of minor bottom score lines configured for folding of the box cutout; four major bottom score lines configured for folding of the box cutout; wherein the bottom panel of the box cutout is collapsed downward about the score line bisecting the bottom panel and the four major bottom score lines, but each of the minor bottom score lines is unbroken.

Another aspect of the present invention relates to a box cutout. The box cutout includes a bottom panel; a score line bisecting the bottom panel; a plurality of minor bottom score lines configured for folding of the box cutout; and a plurality of major bottom score lines configured for folding of the box cutout. The bottom panel of the box cutout is collapsed downward about the score line bisecting the bottom panel and the plurality of major bottom score lines, but each of the minor bottom score lines is unbroken.

Another aspect of the present invention relates to a method of manufacturing a box having a bottom panel, a score line bisecting the bottom panel, a plurality of minor bottom score lines configured for folding of the box, and a plurality of major bottom score lines configured for folding of the box. The method includes collapsing the bottom panel of the box downward about the score line bisecting the bottom panel and the major score lines. Following performance of the method, the box is in a collapsed configuration but the minor score lines are unbroken.

Another aspect of the present invention relates to an apparatus.

Another aspect of the present invention relates to a method.

Another aspect of the present invention relates to a box cutout.

Another aspect of the present invention relates to a method of transitioning a box cutout from a flat configuration to a collapsed configuration.

Another aspect of the present invention relates to a machine for transitioning a box cutout from a flat configuration to a collapsed configuration.

Another aspect of the present invention relates to a box manufactured utilizing a machine for transitioning a box cutout from a flat configuration to a collapsed configuration.

Another aspect of the present invention relates to a system.

Another aspect of the present invention relates to a machine for transitioning a box cutout from a flat configuration to a collapsed configuration comprising: a first drive wheel configured to drive a box cutout towards a plunging area; a plunger configured to apply force to a central portion of a box cutout so as to propel at least a portion of it downward; opposed second and third drive wheels configured to grab a box cutout propelled downward by the plunger and propel it further downward between the second and third drive wheels.

Another aspect of the present invention relates to a box cutout transitioned to a collapsed configuration by a machine comprising: a bottom panel and a plurality of bottom score lines configured for collapsing of the box cutout, the majority of the bottom score lines being unbroken.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings, wherein like elements are referred to with like reference numerals.

DETAILED DESCRIPTION

Figure 1:
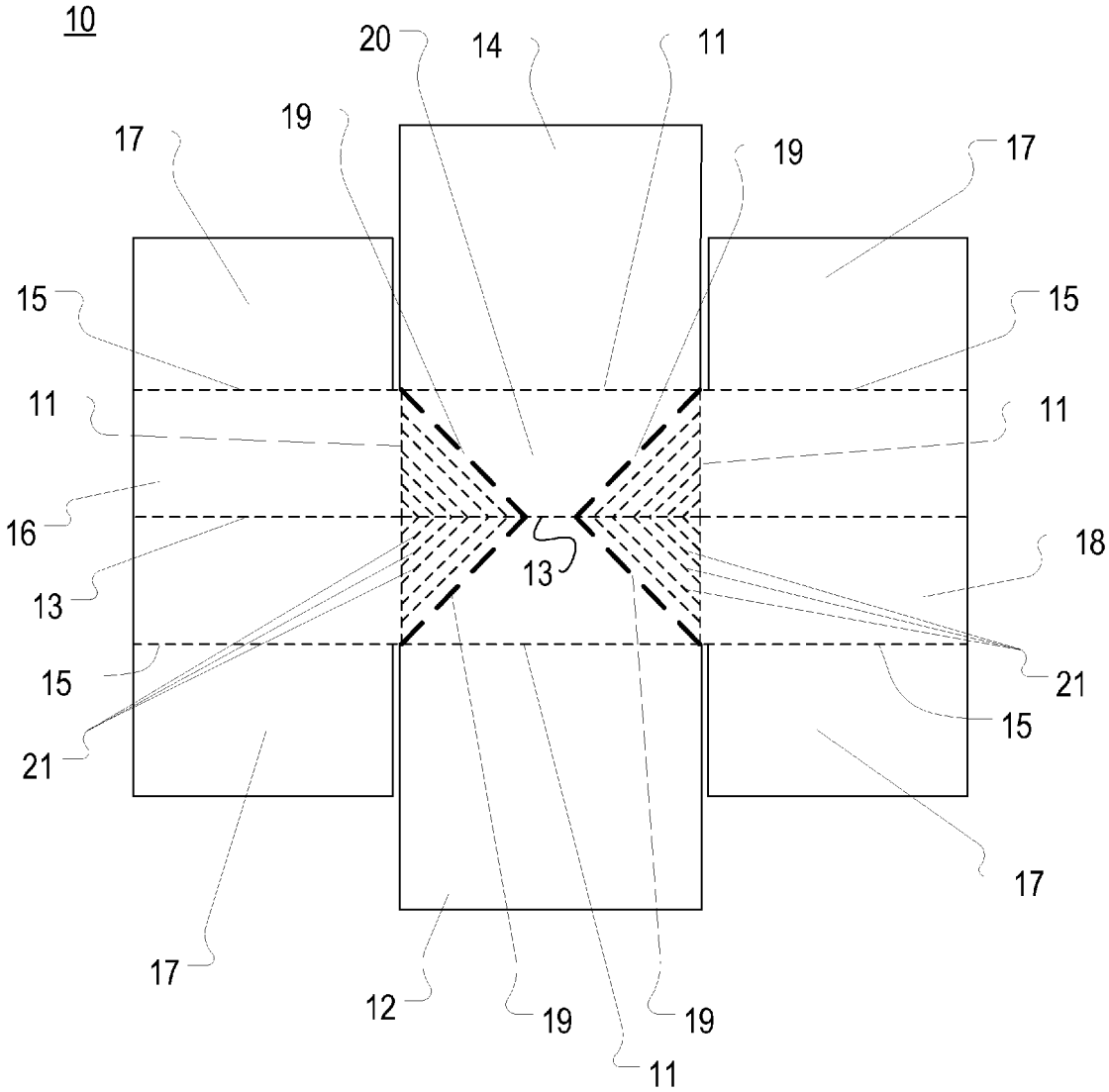
FIG. 1 illustrates a top plan view of an inner side of a blank, or more specifically a box cutout, in accordance with a preferred embodiment of the present invention.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Additionally, as used herein, a "score line" is intended to mean an elongated area along which a fold is predisposed to form upon application of force. Within this broader context, a score line may be a generally linear area of weakness formed in a corrugated or non-corrugated panel along which the panel is predisposed to fold upon application of a force on the panel. A score line may be formed by way of example, and not limitation, by notching, scratching, incision, compression, perforation, physical deformation, or otherwise.

Referring now to the drawings, one or more preferred embodiments of the present invention are next described. The following description of one or more preferred embodiments is merely exemplary in nature and is in no way intended to limit the invention, its implementations, or uses.

Turning now to the figures, FIG. 1 illustrates a blank, or more specifically, a box cutout 10 in accordance with a preferred embodiment of the present invention. The box cutout 10 comprises corrugated cardboard pre-cut in a shape configured to allow the box cutout 10 to be manipulated to form a container, and more specifically a box. It will be appreciated, however, that other materials may well be utilized. For example, in one or more preferred implementations, a blank may comprise paper or plastic, may be comprised of corrugated or non-corrugated material, or may comprise any material commonly utilized for containers used in packaging, shipping, or storage.

FIG. 1 illustrates an inner side of the box cutout 10. The box cutout 10 includes front and back panels 12,14, side panels 16,18, and a bottom panel 20. Each of the front and back panels 12,14 and side panels 16,18 can be characterized as extending from the bottom panel 20 and being separated from the bottom panel 20 by a respective score line 11. Another score line 13 bisects each of the side panels 16,18 and the bottom panel 20.

Each of the side panels 16,18 includes two attachment panels 17 extending therefrom that are each separated therefrom by a respective score line 15. In at least some implementations, each set of two score lines 15 and one score line 11 are segments of, and collective form, a single score line running the width of box cutout 10, just as score line 13 does.

Each of score lines 11,13,15 facilitates folding of the box cutout 10 along that score line. The box cutout 10 is configured such that the scores lines 11,15 facilitate transitioning of the box cutout 10 into a box configuration, and the score line 13 facilitates transitioning of the box configuration between different box configurations, namely, an expanded box configuration and a collapsed box configuration, as described in detail below.

Figure 2:
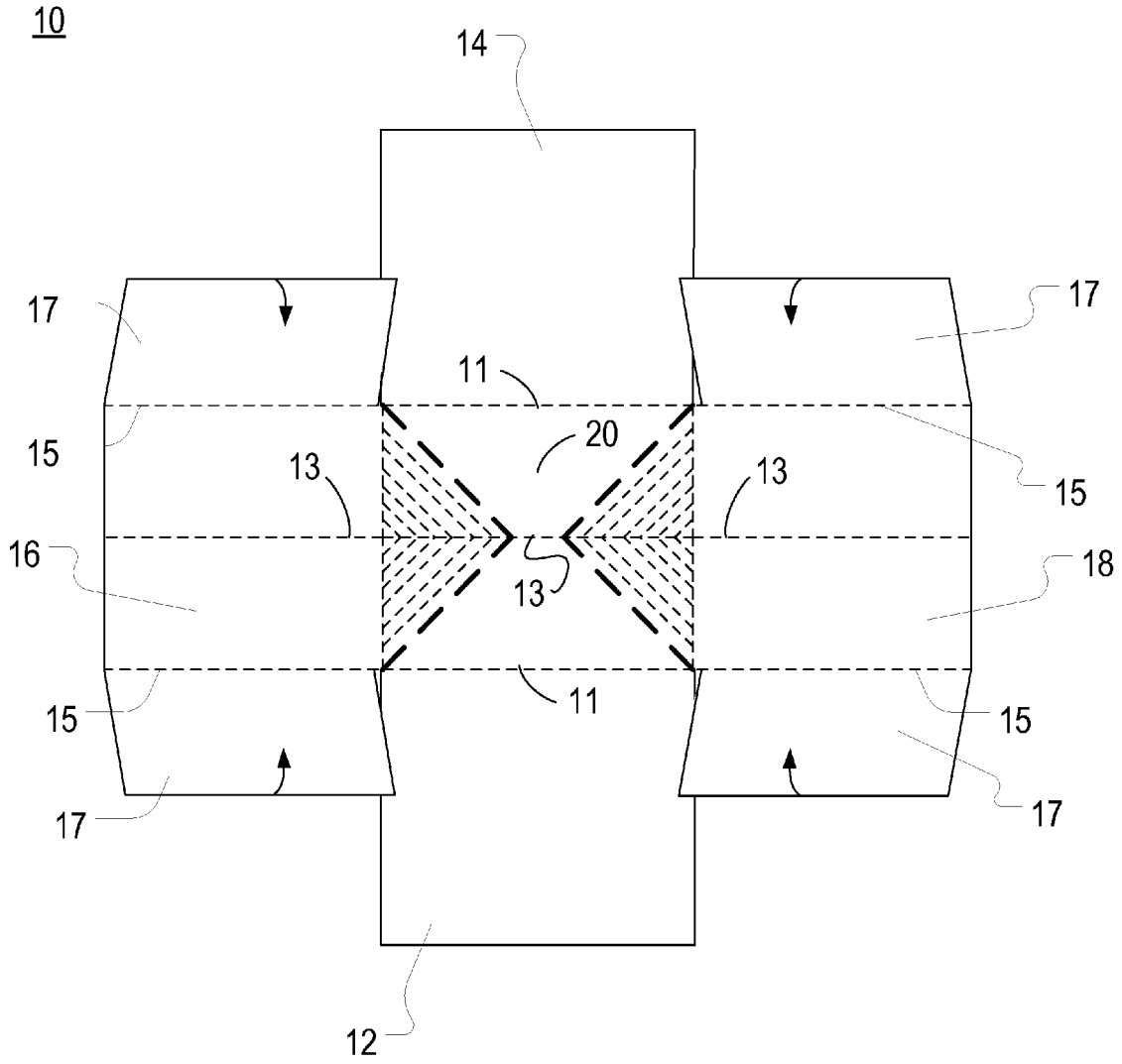
FIGS. 2-7 illustrate folding of the box cutout of FIG. 1 to an expanded box configuration of the box cutout in accordance with a preferred embodiment of the present invention.
Figure 3:
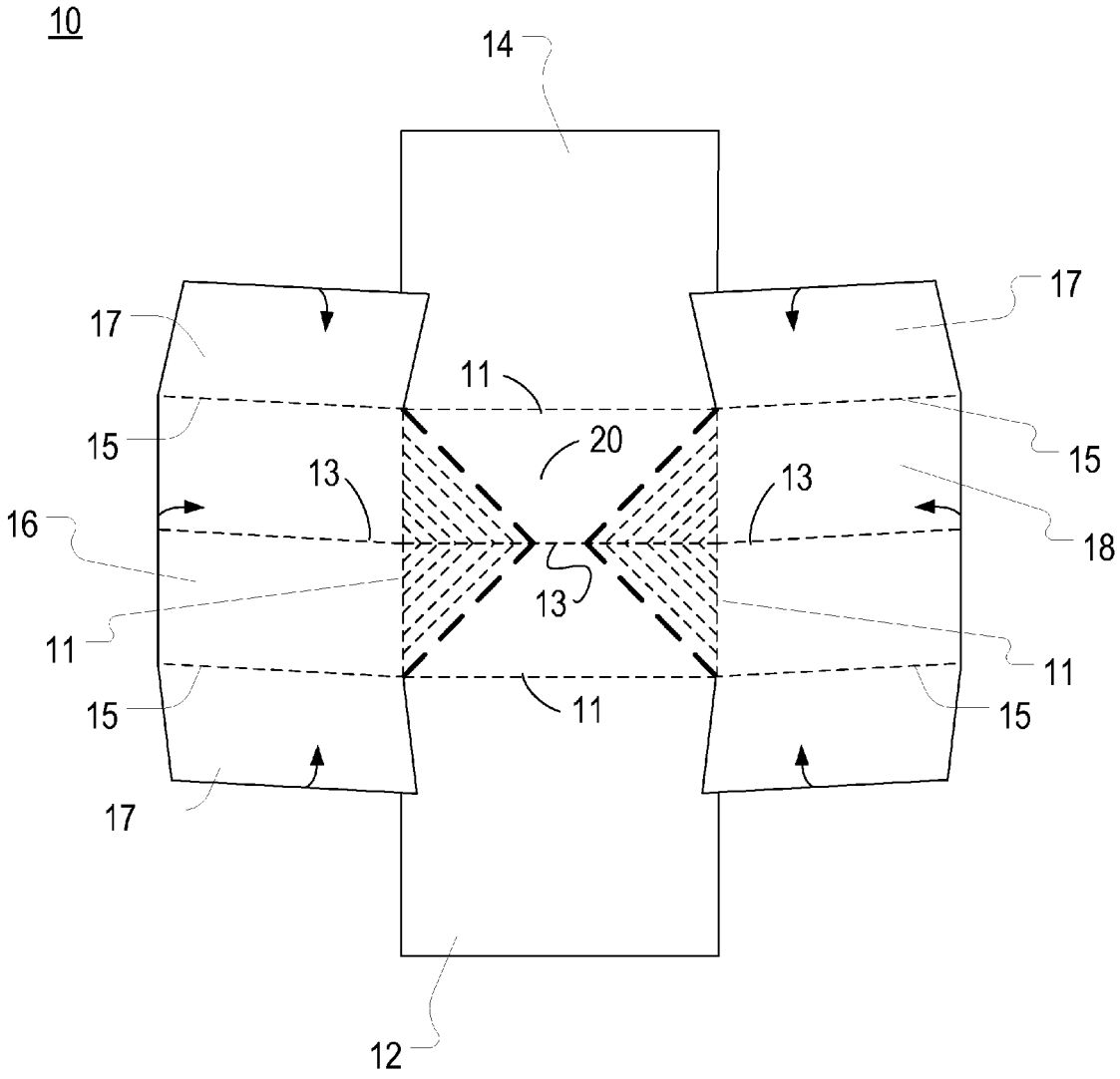
Figure 4:
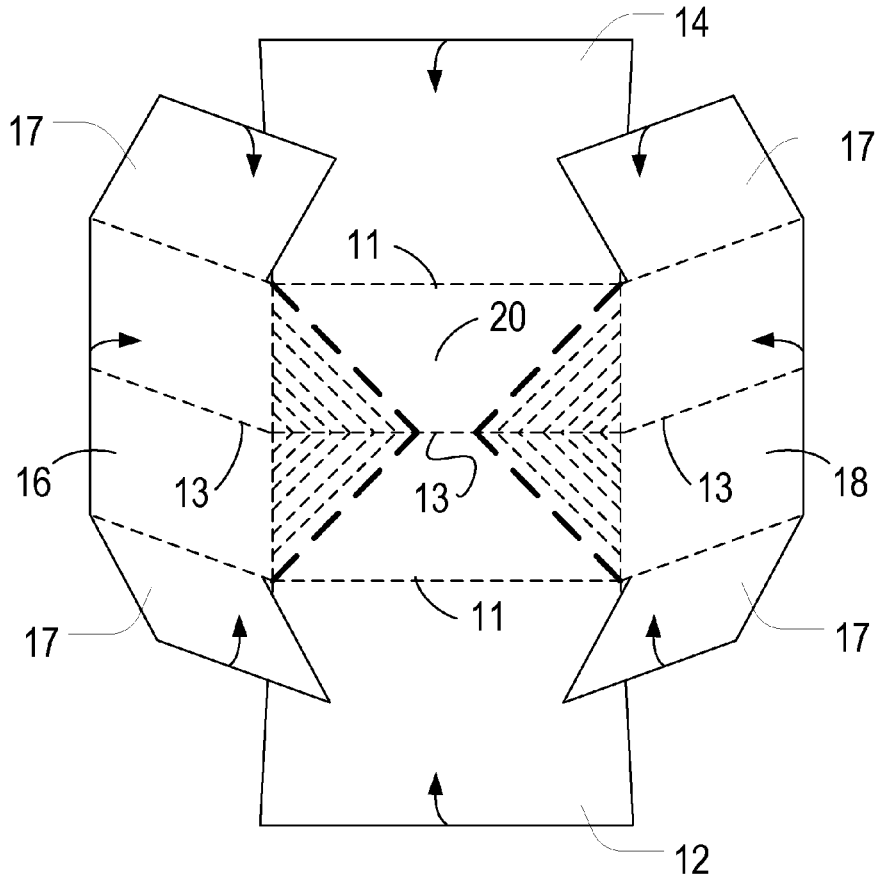

Each of the attachment panels 17 can be folded upward and inward about a respective score line 15, as illustrated by the fold arrows in FIG. 2. Further, each of the side panels 16,18 can, previously, concurrently, or thereafter, be folded upward and inward about a respective score line 11, as illustrated by the additional fold arrows in FIG. 3. Each of the front and back panels 12,14 can, previously, concurrently, or thereafter, be folded upward and inward about a respective score line 11, as illustrated by the additional fold arrows in FIG. 4.

Figure 5:
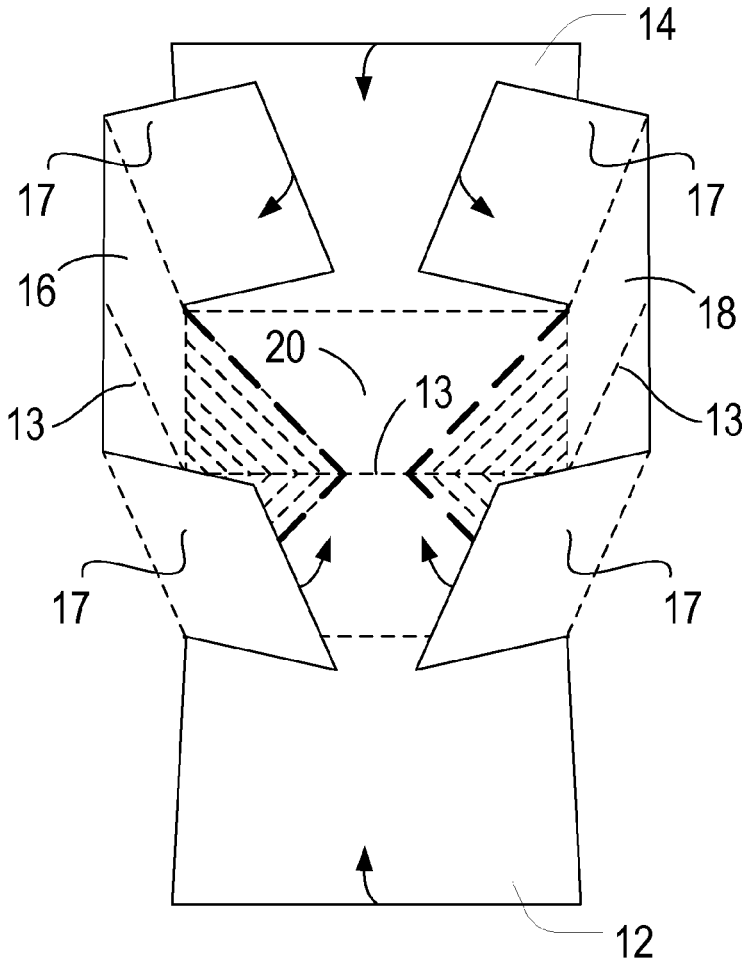
Figure 6:
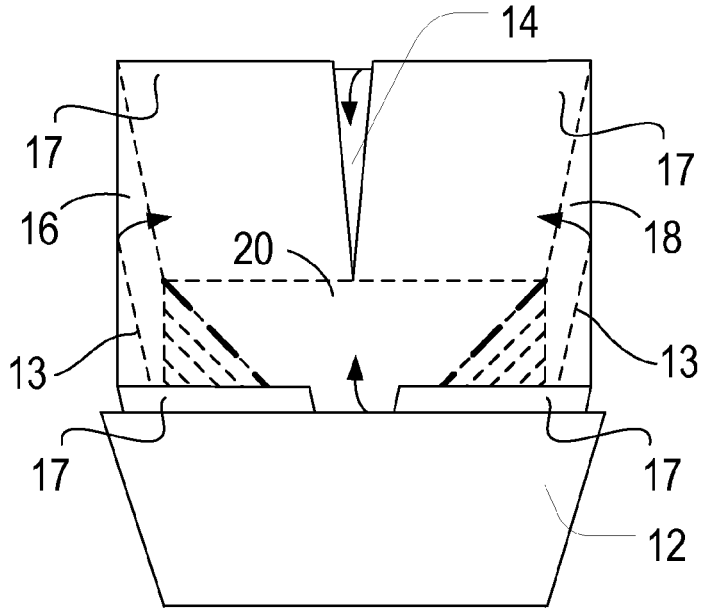
Figure 7:
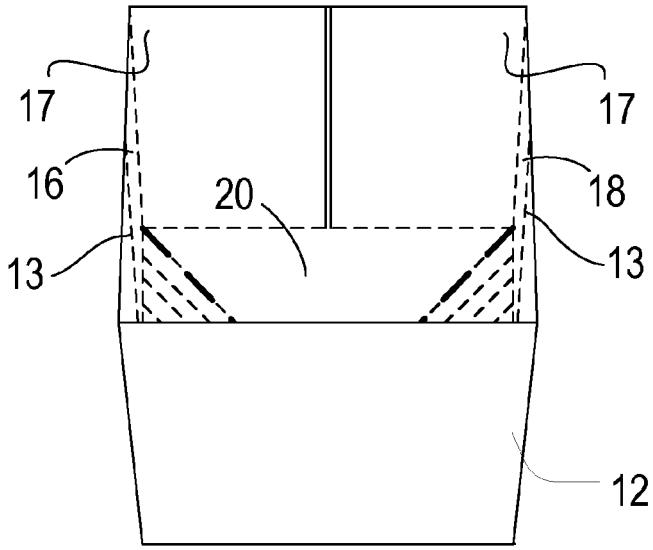

FIG. 5 illustrates the box after side panels 16,18 have been folded upwards towards a position that would be perpendicular with the bottom panel 20. Thereafter or concurrently, the front and back panels 12,14 can similarly be folded upwards as shown in FIG. 6 such that an inner face of the front and back panels 12,14 abuts the outer face of two respective attachment panels 17, as illustrated in FIG. 7. In preferred implementations, the inner face of the front and back panels 12,14 is secured to the outer face of one or more attachment panels 17 via glue applied to one or more of the front and back panels 12,14 and attachment panels 17. Once the front and back panels 12,14 have been secured to the attachment panels 17, the box cutout 10 can be characterized as being in a box configuration as illustrated in FIG. 7.

The box cutout 10 is configured to allow the box cutout 10 to be transitioned to a collapsed box configuration as well, even after securing the front and back panels 12,14 to the attachment panels 17. This collapsing is enabled by both the score lines 13 bisecting the side panels 16,18, and by "major" score lines 19 of the bottom panel 20, which can perhaps best be seen in FIG. 1. Each score line 19 facilitates bending of the bottom panel 20 at that bottom score line 19 as discussed in further detail below.

Figure 8:
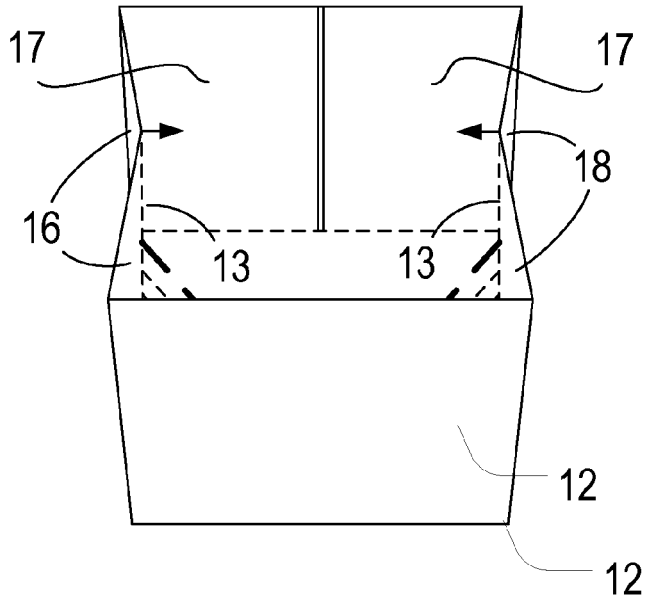
FIGS. 8-10 illustrate folding of the box cutout in the expanded box configuration of FIG. 7 to a collapsed box configuration in accordance with a preferred embodiment of the present invention.
Figure 9A:
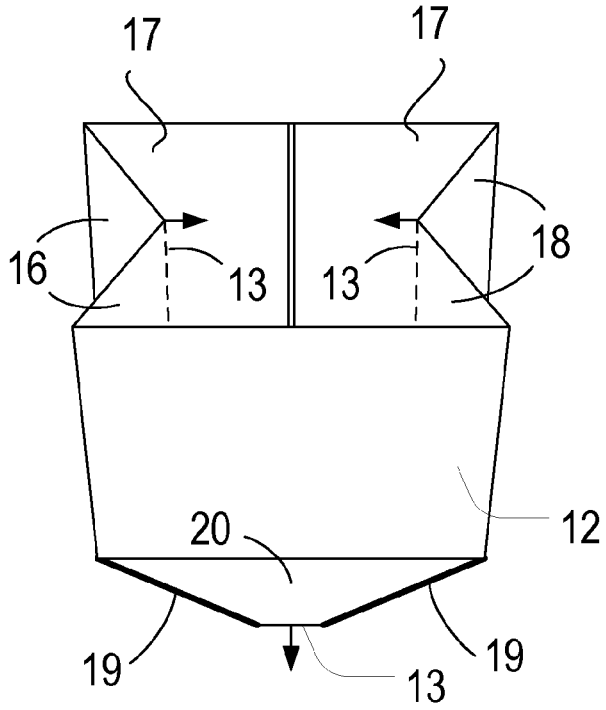
Figure 9B:
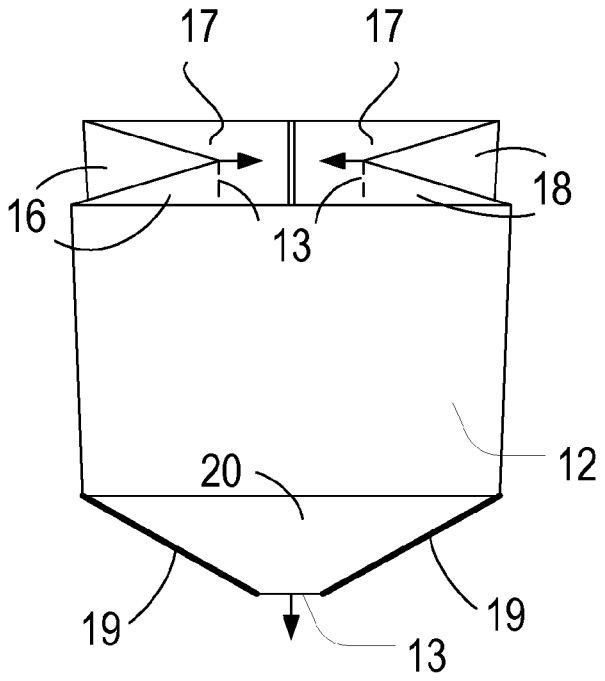
Figure 10:
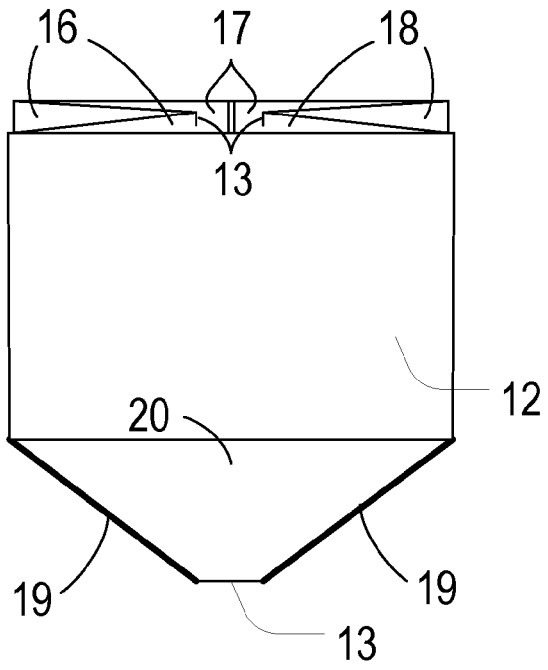

The score lines 13 bisecting the side panels 16,18 allow the side panels to collapse inwards during collapsing of the box cutout 10, as illustrated by the arrows in FIGS. 8-10. Similarly, the shape and position of the major score lines 19 in the bottom panel 20 allows the bottom panel 20 to be collapsed downward during collapsing of the box cutout 10, as illustrated by the additional arrows in FIGS. 9A-B. FIG. 10 illustrates the box cutout 10 in a collapsed configuration.

During collapsing, minor score lines 21 in the bottom panel 20, which are illustrated in the drawings and called out at least in part in FIG. 1, also may be broken, at least in some methods of collapsing the box cutout 10; however, in one or more manufacturing methods in collapsed box cutouts 10 as further described below, especially in methods utilizing a plunger, it will be appreciated that minor score lines 21 may not be broken during collapse and remain "virgin" or unbroken score lines until such time as a user manually expands an individual box for use.

Figure 11:
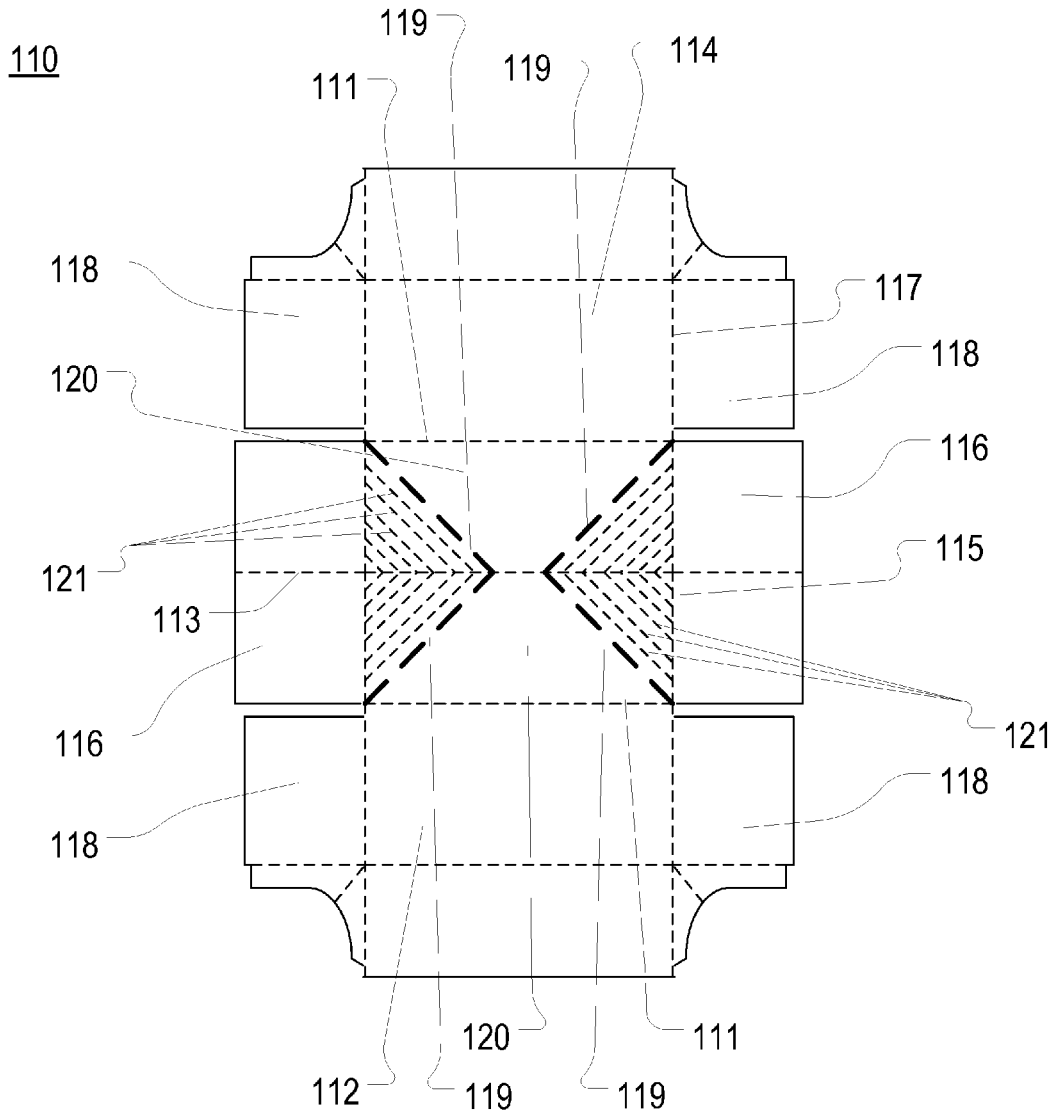
FIG. 11 illustrates a top plan view of an inner side of a box cutout in accordance with another preferred embodiment of the present invention.

FIG. 11 illustrates the inner side of another box cutout 110. The box cutout 110 includes front and back panels 112,114 and a bottom panel 120. The front and back panels extend from the bottom panel 120 and are separated therefrom by score lines 111.

The box cutout 110 is similar to the box cutout 10, but is configured such that attachment panels 118 extend from the front and back panels 112,114 instead of from side panels 116. In this regard, side panels 116 are secured to attachment panels 118 to collectively form sides of a box when the box cutout 110 is transitioned to a box configuration.

Similar to the box cutout 10, the box cutout 110 also includes a score line 113 which bisects the bottom panel 120, and each of the side panels 116 extending therefrom. The box cutout 110 further similarly includes major score lines 119 and minor score lines 121 in the bottom panel 120.

The score line 113 which bisects the bottom panel 120 and each of the side panels 116, together with the major score lines 119, enable the bottom panel 120 and the side panels 116 to be collapsed via folding in a manner similar to that described above with respect to the box cutout 10.

Figure 12:
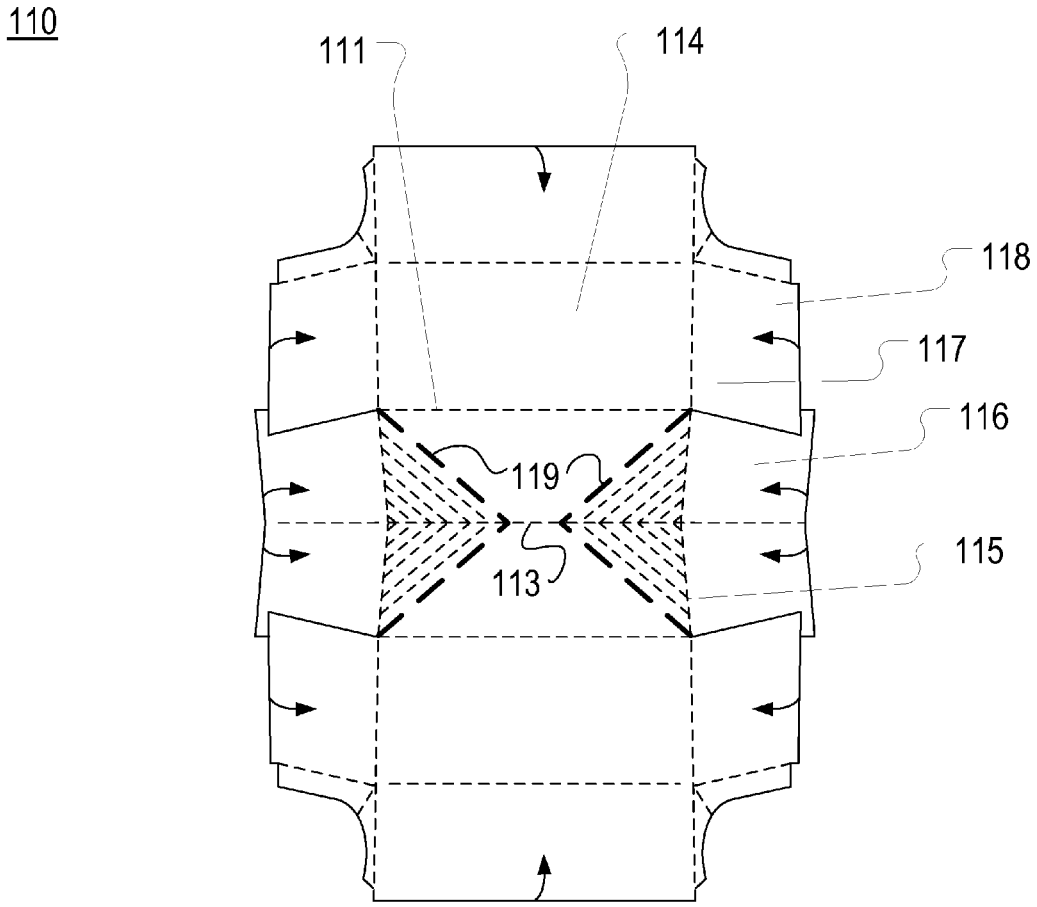
FIGS. 12-15 illustrate folding of the box cutout of FIG. 11 to a collapsed box configuration of the box cutout in accordance with a preferred embodiment of the present invention.
Figure 13:
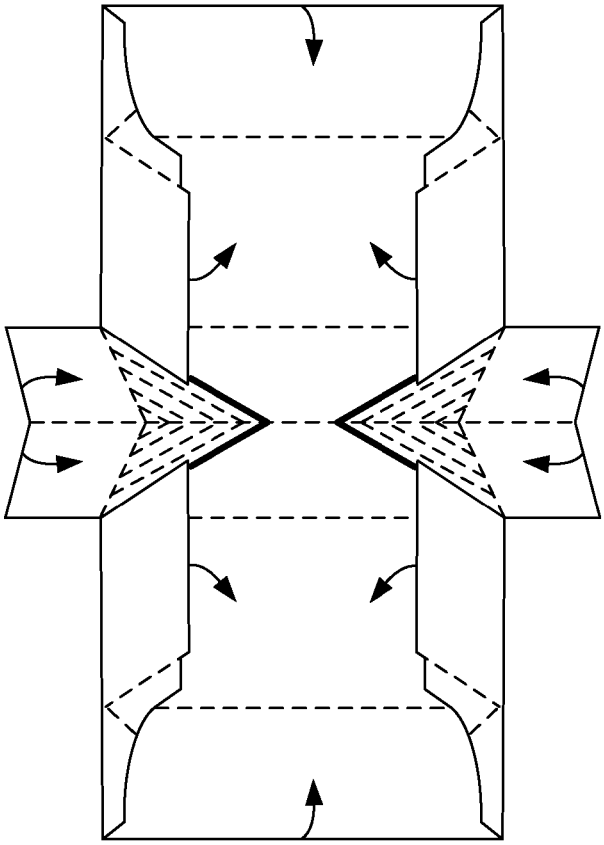
Figure 14:
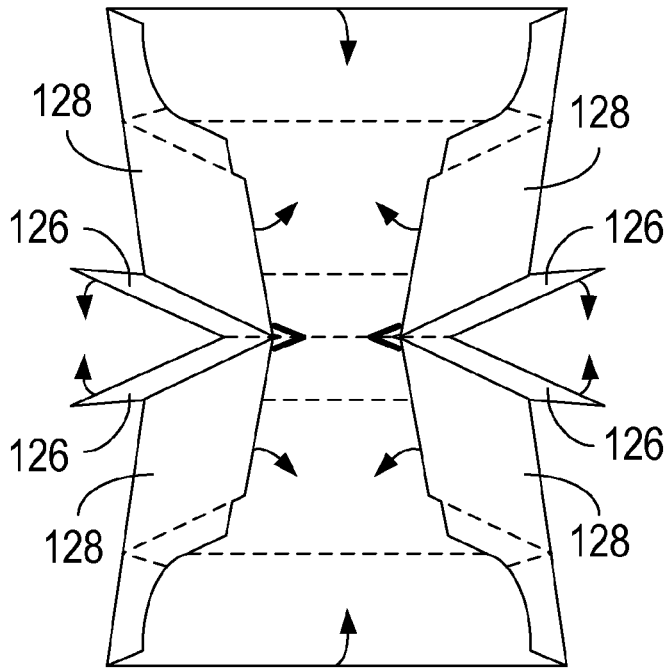

It will be appreciated that each of the box cutout 10 and box cutout 110 can be transitioned to a fully formed but folded and collapsed configuration from an initial, flat, unfolded configuration without first being transitioned to a box configuration. For example, with regard to box cutout 110, top and bottom halves of the box cutout 110 can be folded together about the score line 113 which bisects the bottom panel 120 and each of the side panels 116 while the bottom panel 120 is collapsed downward as enabled by one or more of the major score lines 119. As the bottom panel 120 is folded about the score line 113 which bisects it and one or more of the major score lines 119, the center of each side panel 116 is preferably transitioned upward and inward as the side panel folds along the score line 113 which bisects it, as illustrated in FIGS. 12-14.

Previously or concurrently, the attachment panels 118 can be folded inward about the score lines 117. Consequently, as the box cutout 110 is folded in half about the score line 113 which bisects the bottom panel and the side panels 116, and about one or more of the bottom score lines 119, an outer face 128 of each of the attachment panels 118 extending from the top or bottom panel 112,114 comes into abutment with an inner face 126 of one of the side panels 116 extending from the bottom panel 120, as perhaps best seen with reference to FIG. 14. In preferred implementations, such inner and outer faces 126,128 are secured together via glue applied to one or more of the inner and outer faces 126,128.

It will be appreciated that a similar—but not identical—process can be utilized with box cutout 10.

Figure 15:
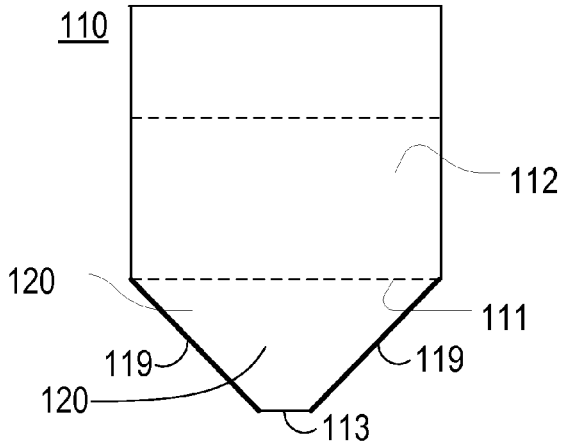

FIG. 15 provides a front view of the box cutout 110 after such inner and outer faces 126,128 have been secured together and the box cutout 110 has been folded and collapsed as described.

Figure 16A:
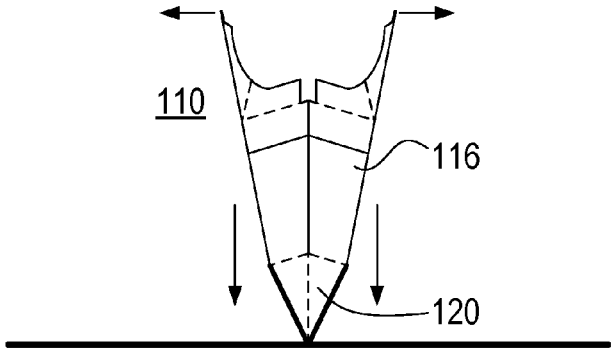
FIGS. 16A-16C illustrate folding of the box cutout in the collapsed box configuration of FIG. 15 to an expanded box configuration in accordance with a preferred embodiment of the present invention.
Figure 16B:
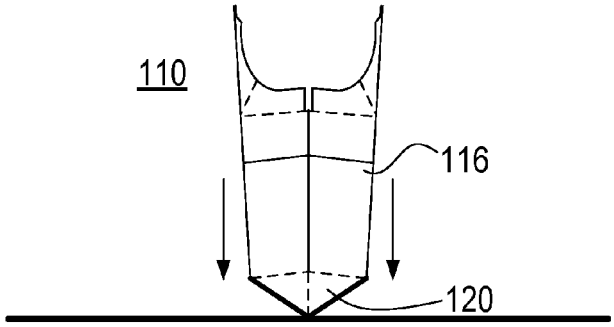
Figure 16C:
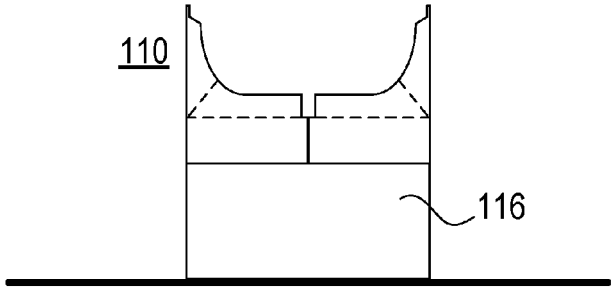
Figure 16D:
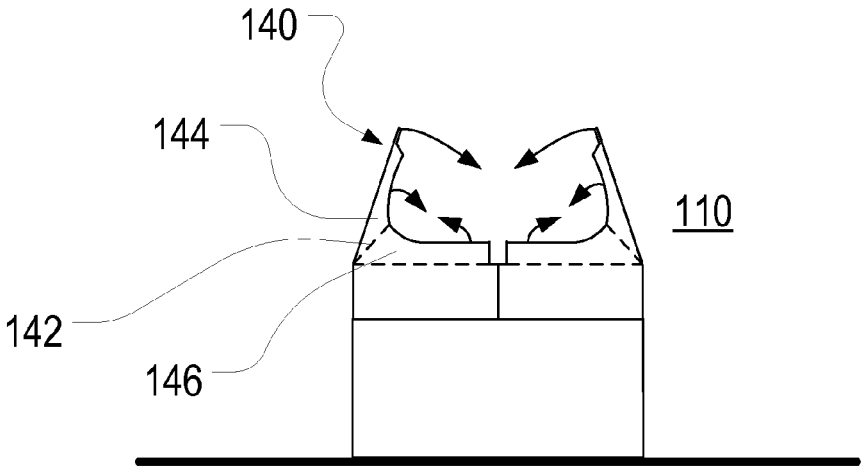
FIGS. 16D-16E are additional illustrations of the box cutout of FIG. 11 in the expanded box configuration.
Figure 16E:
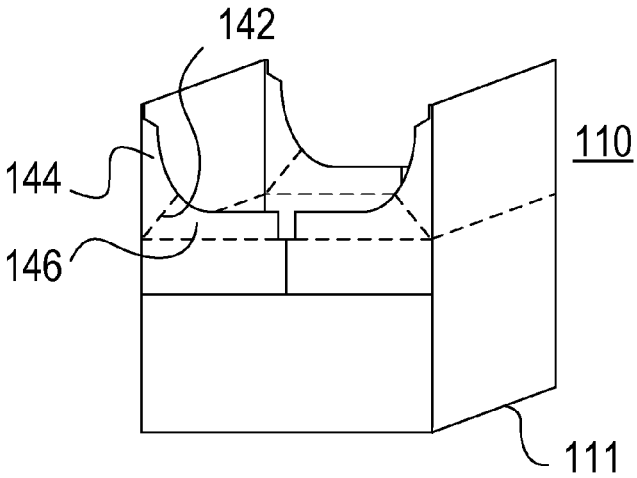

The box cutout 110 can be transitioned from the folded and collapsed configuration illustrated in FIG. 15 to an expanded box configuration by pressing the bottom portion of the collapsed bottom panel 120 downward against a surface, as illustrated via side views in FIGS. 16A-B. Such expansion can be facilitated by, previously or concurrently pulling apart the front and back panels 112,114, as also illustrated in FIG. 16A. FIG. 16C is a side view of the box cutout 110 in an expanded box configuration, and FIG. 16E is a perspective view of the box cutout 110 in an expanded box configuration. It is intended that such method be employed by a user when a box is desired. Furthermore, it is believed that minor score lines 21 in box cutout 10, and minor score lines 121 in box cutout 110, facilitate such manner of manually expanding the box by a user and that virgin score lines 21 in box cutout 10, and that virgin score lines 21 in box cutout 10, and virgin score lines 121 in box cutout 110, are broken during such expansion method by a user.

Unlike exemplary box cutout 10, exemplary box cutout 110 is further configured to be closed via a cover formed from integral cover portions 140 of the box cutout 110. The box cutout 110 includes cover score lines 142 that are configured to allow hinge portions 144,146 to be folded inward about the cover score lines 142 so as to allow the cover portions 140 of the box cutout 110 to fold down to form a cover for the box cutout 110 when it is in a box configuration, as illustrated in FIG. 16D.

Notably, the box cutout 10 and the box cutout 110 can both be transitioned from a flat or collapsed box configuration to an expanded box configuration and be used for storage without utilizing tape to secure either cutout in a box configuration. Further, the configuration of both box cutout 10 and box cutout 110 results in the box cutout, when in a box configuration, having reinforced double wall sides that are believed to be superior in stacking strength as compared to a conventional box with a single wall side.

In a preferred method of manufacturing a box, a box cutout, such as box cutout 110, is automatically transitioned from an initial, flat, unfolded configuration (such as that illustrated in FIG. 11), to a fully formed but folded and collapsed configuration (such as that illustrated in FIG. 15) via use of a machine configured to effect such transition. An exemplary machine 210 configured to process box cutouts 110 will now be described.

Figure 17:
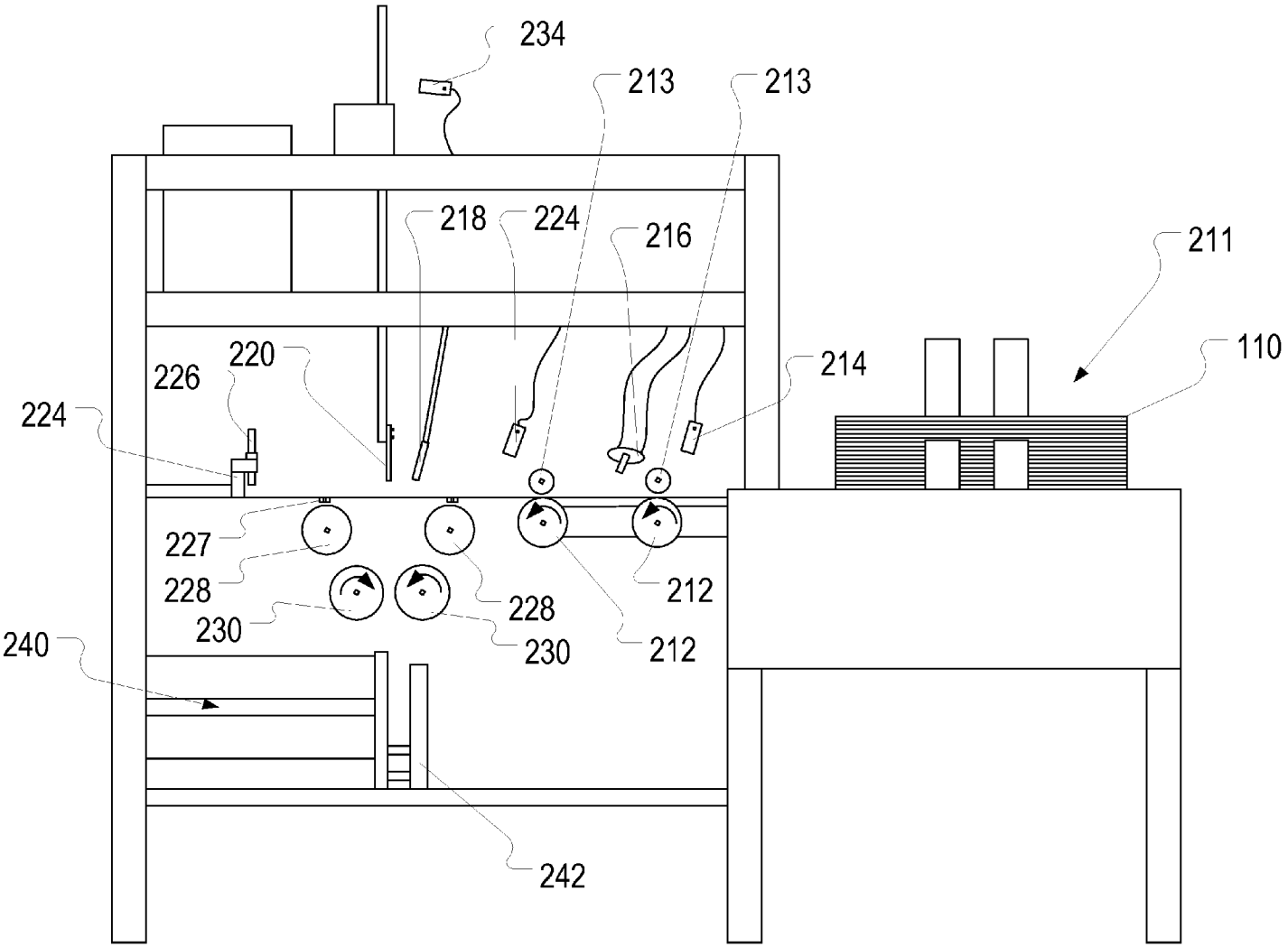
FIGS. 17-29 illustrates a machine, components thereof and manufacturing method, all in accordance with one or more preferred embodiments of the invention.

FIG. 17 is a schematic side view of the machine 210. As illustrated, the machine 210 includes a blank receiving area 211 that is configured to receive and retain one or more box cutouts 202 when in a flat, unfolded configuration as input feed.

Figure 18:
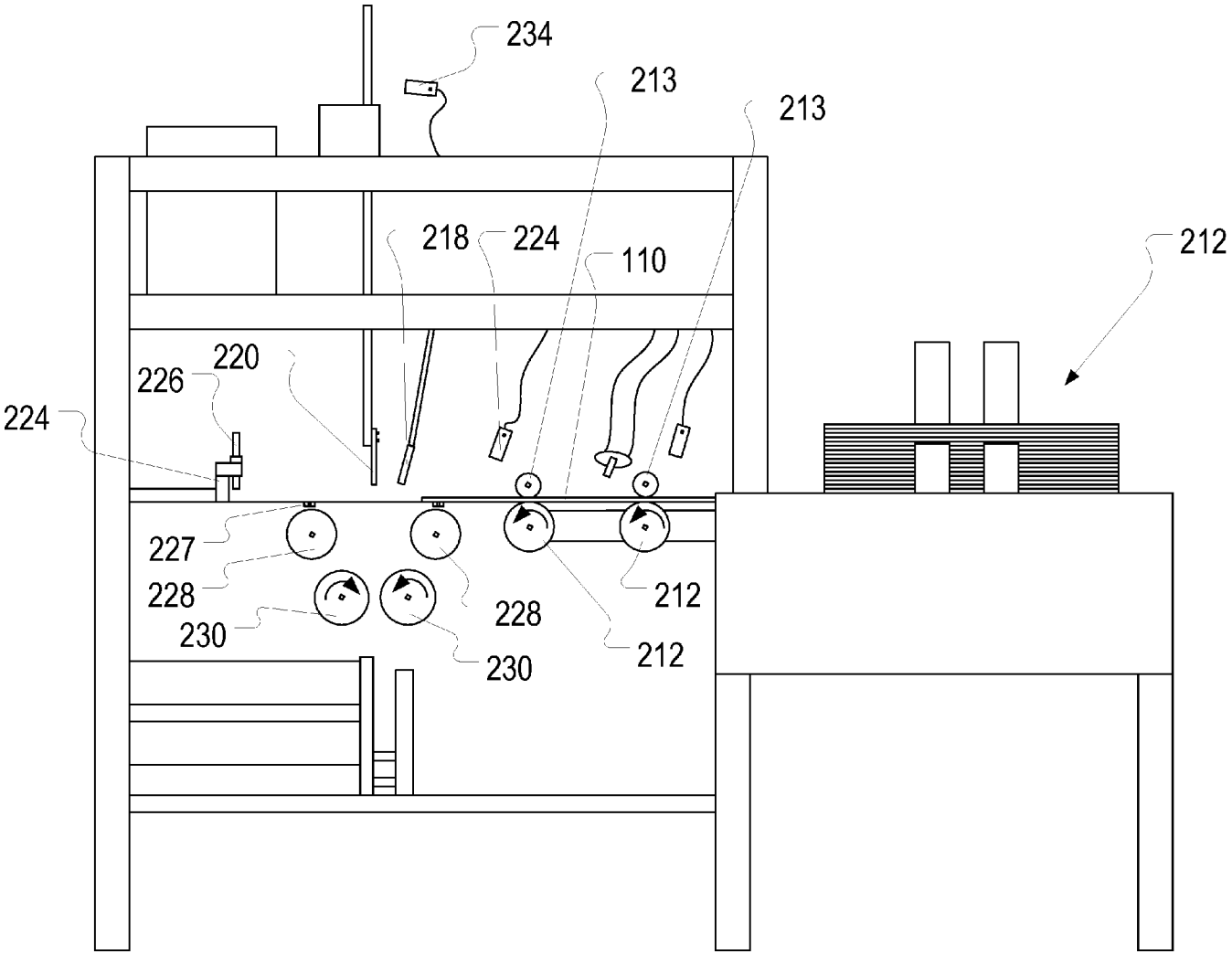
Figure 19:
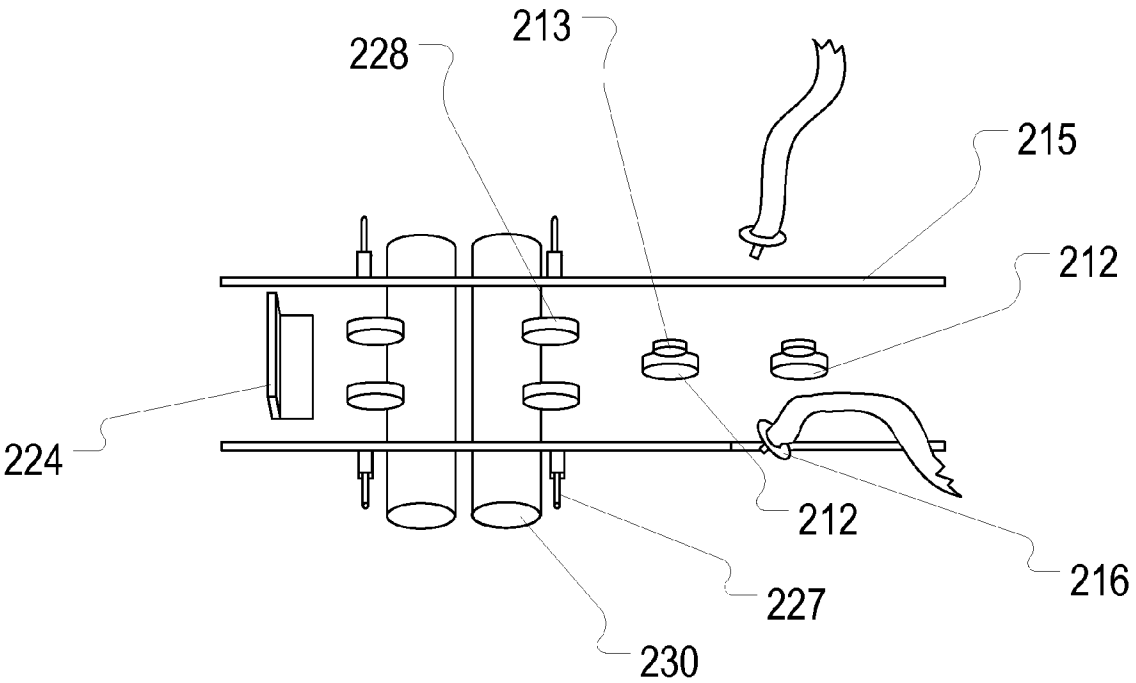
Figure 20:
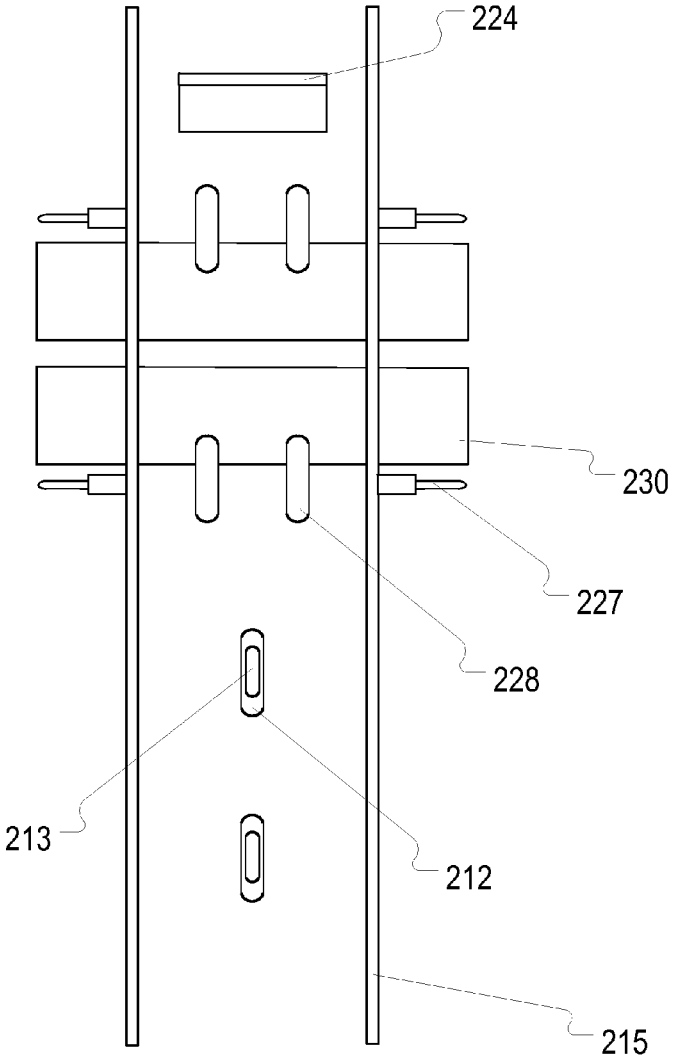

The machine 210 is configured to repeatedly drop down the bottom most box cutout 110 in the cutout receiving area 211 and push it forward so that it travels atop guide rails 215 (shown in FIG. 19) and engages drive wheels 212, as illustrated in FIGS. 18 and 19, thereby feeding blanks to the machine. FIG. 19 is a schematic perspective view of certain components of the machine 210 of FIG. 17, and FIG. 20 is a schematic top view of certain components of the machine 210 of FIG. 17, each of which better illustrates the guide rails 215.

Preferably, a freely rotating wheel 213, i.e. a free wheel, is disposed above each drive wheel 212. Such free wheels 213 serve to, inter alia, minimize or preclude lifting of a box cutout 202 that is engaged and propelled by the drive wheels 212.

The machine 210 includes a first sensor or detector 214, preferably in the form of a laser detector, and one or more glue applicators 216. In operation, the first laser detector 214 detects the presence of a box cutout 202, and triggers application of glue to the box cutout 110 via the one or more glue applicators 216. The glue is preferably fast drying glue; however, it will be appreciated that the process need not pause in order for the glue to set, as the glued portions are properly disposed in abutting engagement when the cutout 110 is in the collapsed box configuration, thereby enabling the glue to set, if necessary or desired, in the collection area or pen the machine 210.

Figure 21:
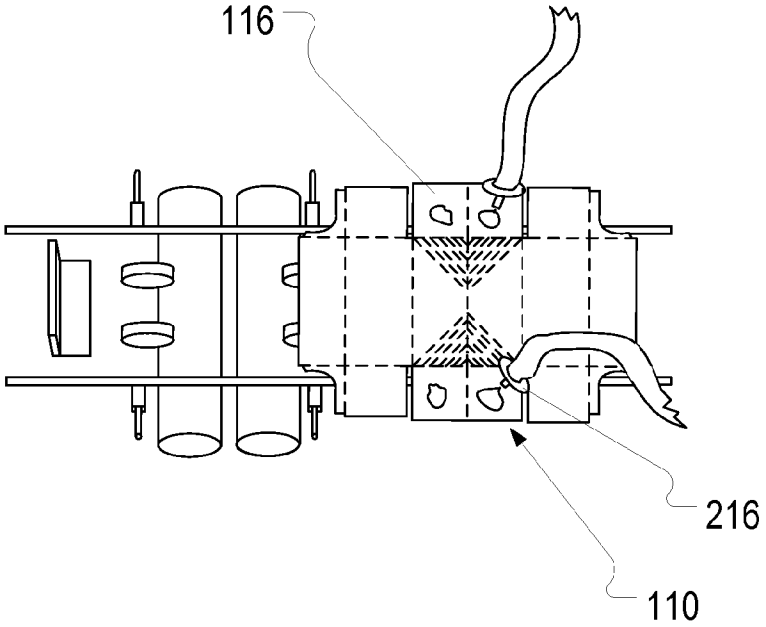

FIG. 21 is a stylized illustration of the application of glue to attachment panels 116 of a box cutout 110 using glue applicators 216 from the schematic perspective view of FIG. 18. It will be appreciated that, in practice, the glue is sprayed onto the panels as the cutout is whisked by at high speed without stopping.

Figure 22:
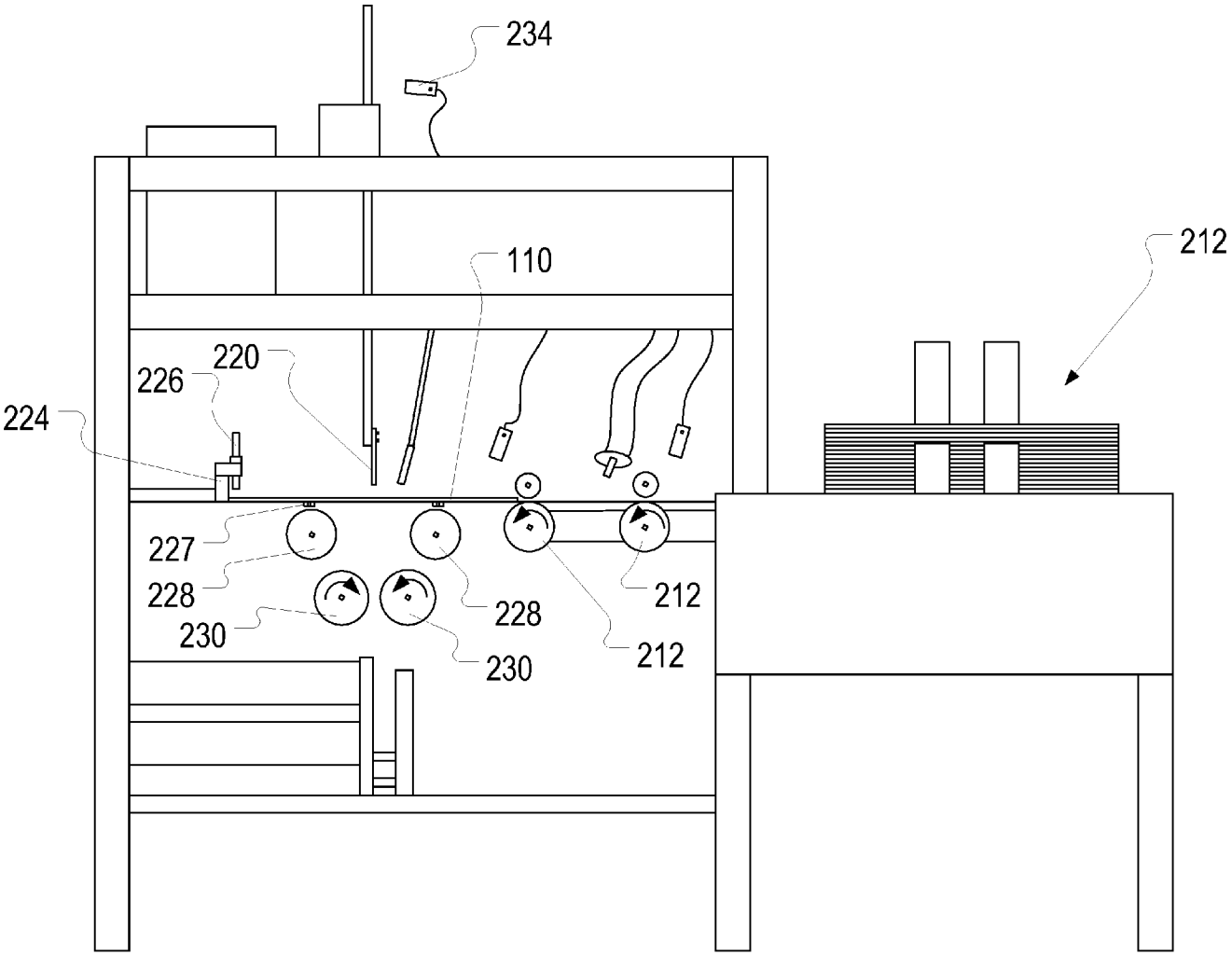

After glue application, the box cutout 110 continues to be driven forward by a second drive wheel 212 so as to position the box cutout 110 under a plunger 220, as illustrated in FIG. 22. Preferably, a free wheel is disposed above the second drive wheel 212 to minimize or obviate lifting of a box cutout 110 engaged by the second drive wheel. In some preferred implementations, a deflector 218 is further utilized immediately upstream of the plunger 220. In the event that a box cutout 218 begins to lift up as it travels at high speed towards the plunger 220, the deflector 218 serves to deflect the box cutout 110 downward so that the leading edge of the box cutout 110 passes under the plunger 220. In some preferred implementations, the deflector is comprised of a pliable material, e.g. a silicon plastic or other plastic material.

The machine 210 includes a backstop 224, which is positioned relative to the plunger based on the dimensions of box cutouts 110 such that, when an end of a box cutout 110 encounters the backstop 224, a central portion of that box cutout 110 generally stops directly below the plunger 220, as illustrated in FIG. 22. Further, the second drive wheel 212 is preferably positioned relative to the plunger 220 such that, when the box cutout 110 is no longer being driven by the second drive wheel 212, a central portion of the box cutout 210 is disposed directly below the plunger 220, as also generally illustrated in FIG. 22.

In preferred implementations, the backstop 224 and/or one or more of the drive wheels 212 are adjustable to allow for adjustment for various sized and shaped box cutouts.

The machine 210 includes a second laser detector 224, which is utilized to trigger the beginning of a plunging routine. In some preferred implementations, the machine 210 includes one or more "flippers" or rotational fingers 227, which are configured to effect the flipping up or folding of a portion of a box cutout 202 once it is in position. Preferably, the activation of such rotational fingers 227 represents a step of a plunging routine triggered by the second laser detector 224.

In some preferred implementations, one or more clamps 226 are utilized to clamp down on a box cutout 202 to ensure proper positioning or folding of portions of a box cutout 202, e.g. during manipulation by rotational fingers 227.

Figure 23:
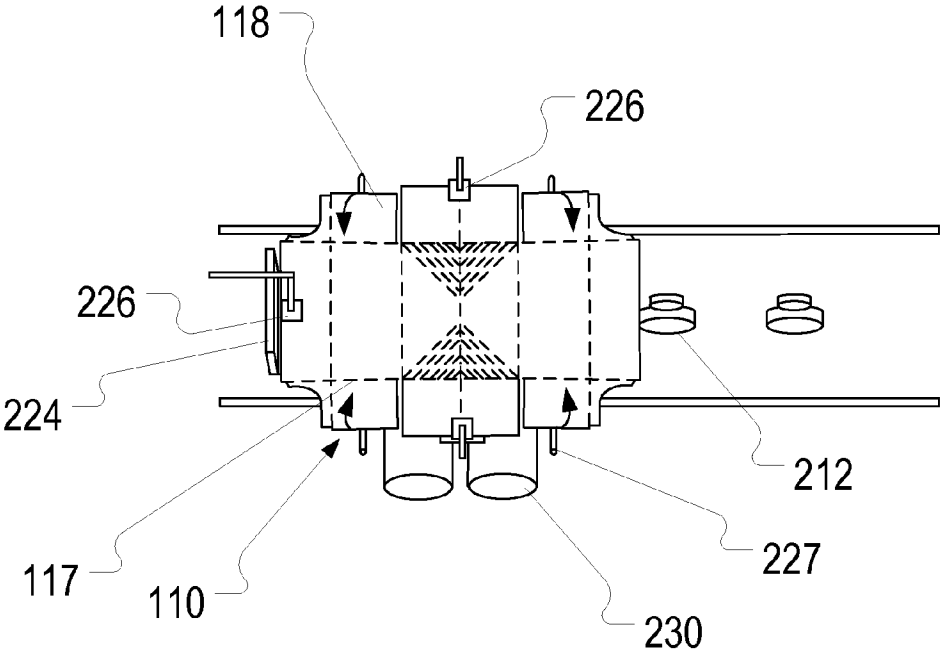
Figure 24:
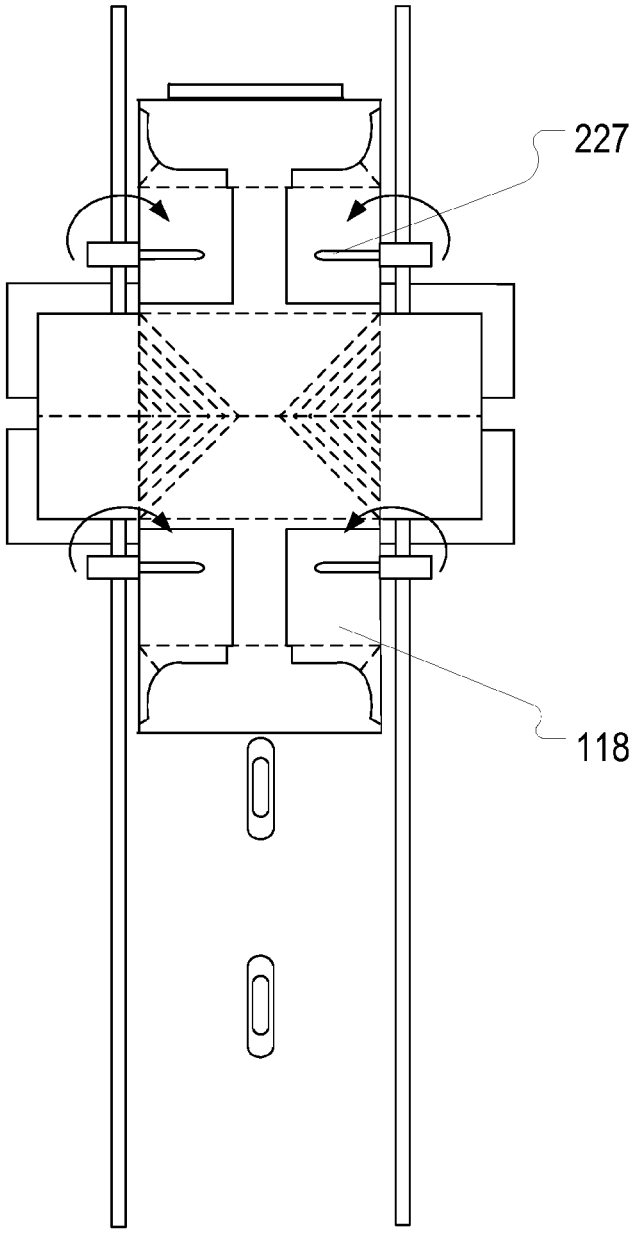

FIG. 23 illustrates the use of rotational fingers 227 to effect folding inwards of attachment panels 118 of a box cutout 110 and the use of clamps 226 to ensure proper folding along score lines 117 of the box cutout 110. FIG. 24 illustrates the box cutout 110 after such folding of the attachment panels 118.

Following any such folding, the plunger 220 is utilized to effect collapsing of a box cutout 110 via collapsing of the bottom panel 120 of the box cutout 110 downward. The plunger 220 effects such collapsing by thrusting downward against a middle portion of the score line 113 bisecting the bottom panel 120 of the box cutout 110.

The plunger 220 is preferably driven by a plunging mechanism for effecting movement of the plunging instrument. The plunging mechanism may comprise, for example, an elongate rod or bar that is mechanically, electrically, and/or pneumatically driven. In at least some implementations, some or all components of such a plunging mechanism may be integrated with, or considered part of, plunger 220.

The plunger 220 preferably comprises a plunging head. The plunging head is preferably sized and dimensioned based on the box cutout it is to apply pressure to. For example, for the box cutout 110, the plunging head preferably has a length generally corresponding to the length of the score line 113 that lies between left and right sets of the innermost lines formed in the bottom panel 120 of the box cutout 110, i.e., which preferably are the major score lines 119 in the box cutout 110.

Figure 25A:
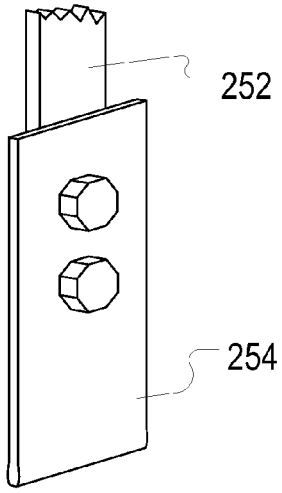

The plunging head preferably tapers to a blunt end, e.g. a narrow curved or planar face, although in at least some implementations the plunging head may simply be thin and may not taper at all. Preferably, the plunging head does not taper to a sharp edge, although in at least some implementations it may taper to an edge. FIG. 25A is a fragmented illustration of an exemplary plunger comprising a plunging bar 252 and a plunging head 254 that might be utilized in one or more preferred implementations. An end of the plunging head 254 is slightly curved forming a blunt plunging face which is configured to engage a box cutout when the plunging head is utilized.

Figure 25B:
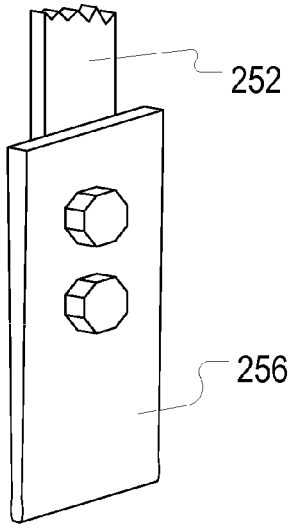
Figure 25C:
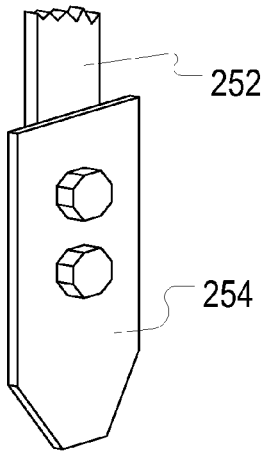

In one or more preferred implementations, a plunger is configured such that plunging heads are removable and interchangeable. FIG. 25B is a fragmented illustration of the exemplary plunger utilizing plunging head 256 rather than plunging head 254. Plunging head 256 is similar to plunging head 254 but, in addition to gently curving at one end, it tapers toward that end as well. In at least some implementations, a plunging head tapers but does not include any gentle curve proximate an end. The plunging head also may include different side profiles. For example, the plunging head 254 attached to plunging bar 252 in FIG. 25*c* includes a trapezoidal profile.

FIGS. 26A-B and 27A-B schematically illustrate plunging of a box cutout 110 from side and top perspectives, respectively. As the plunger 220 descends, the bottom panel 120 of the box cutout 110 is collapsed downward about score line 113 bisecting the bottom panel 120 and about one or more of the major score lines 119, as described hereinabove with respect to FIGS. 13-15. During plunging (and/or thereafter as described hereinbelow when a box cutout passes between drive wheels) attachment panels of the box cutout 110 are brought into abutment with each other and glue applied via the one or more glue applicators 216 secures such attachment panels to one another as described hereinabove with respect to FIGS. 13-15. Importantly, in at least some preferred implementations, the plunger descends with sufficient precision and force to effect breaking of, and folding about, the major score lines 119 of the bottom panel 120, while leaving the remaining minor bottom score lines 121 unbroken.

Figure 26A:
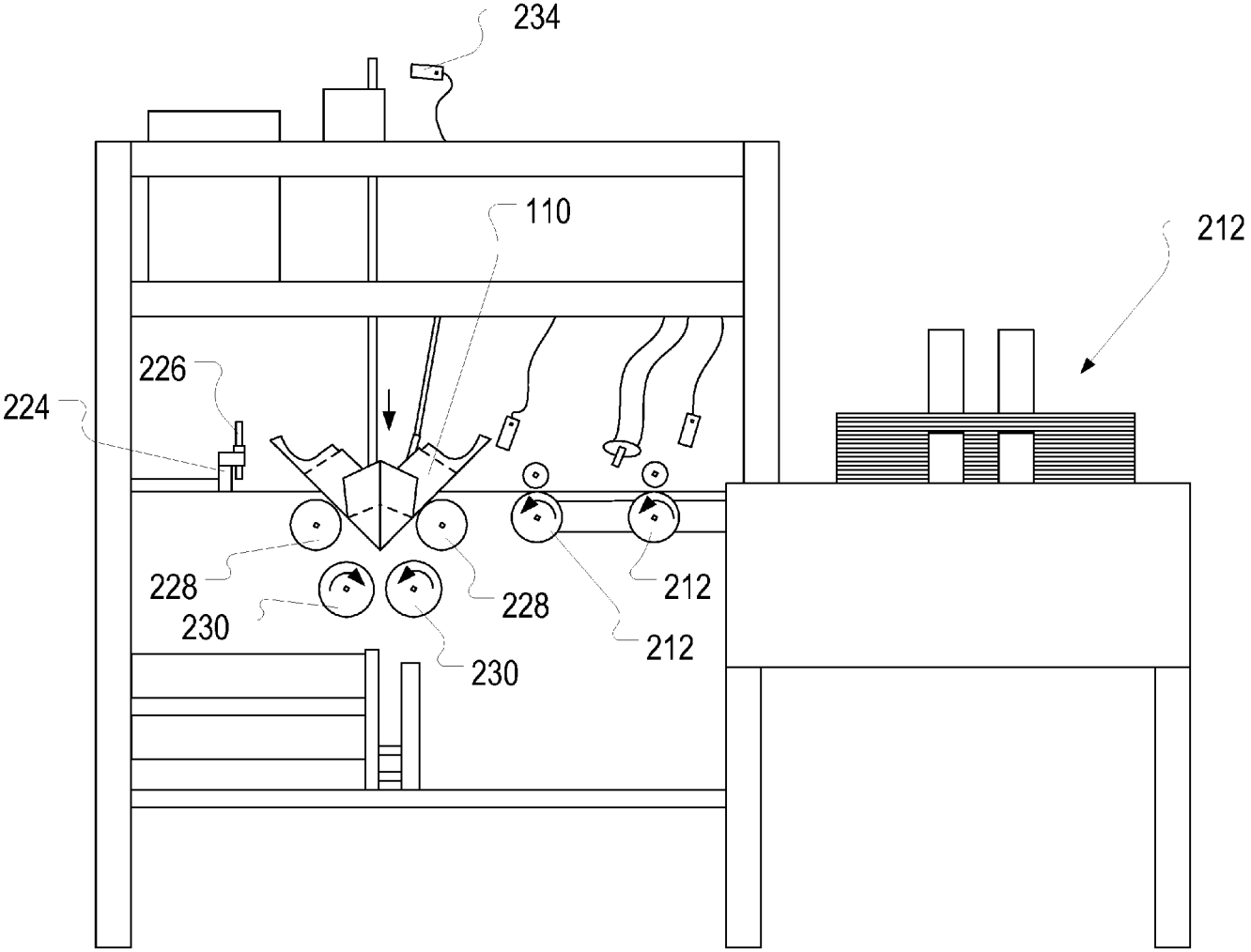
Figure 26B:
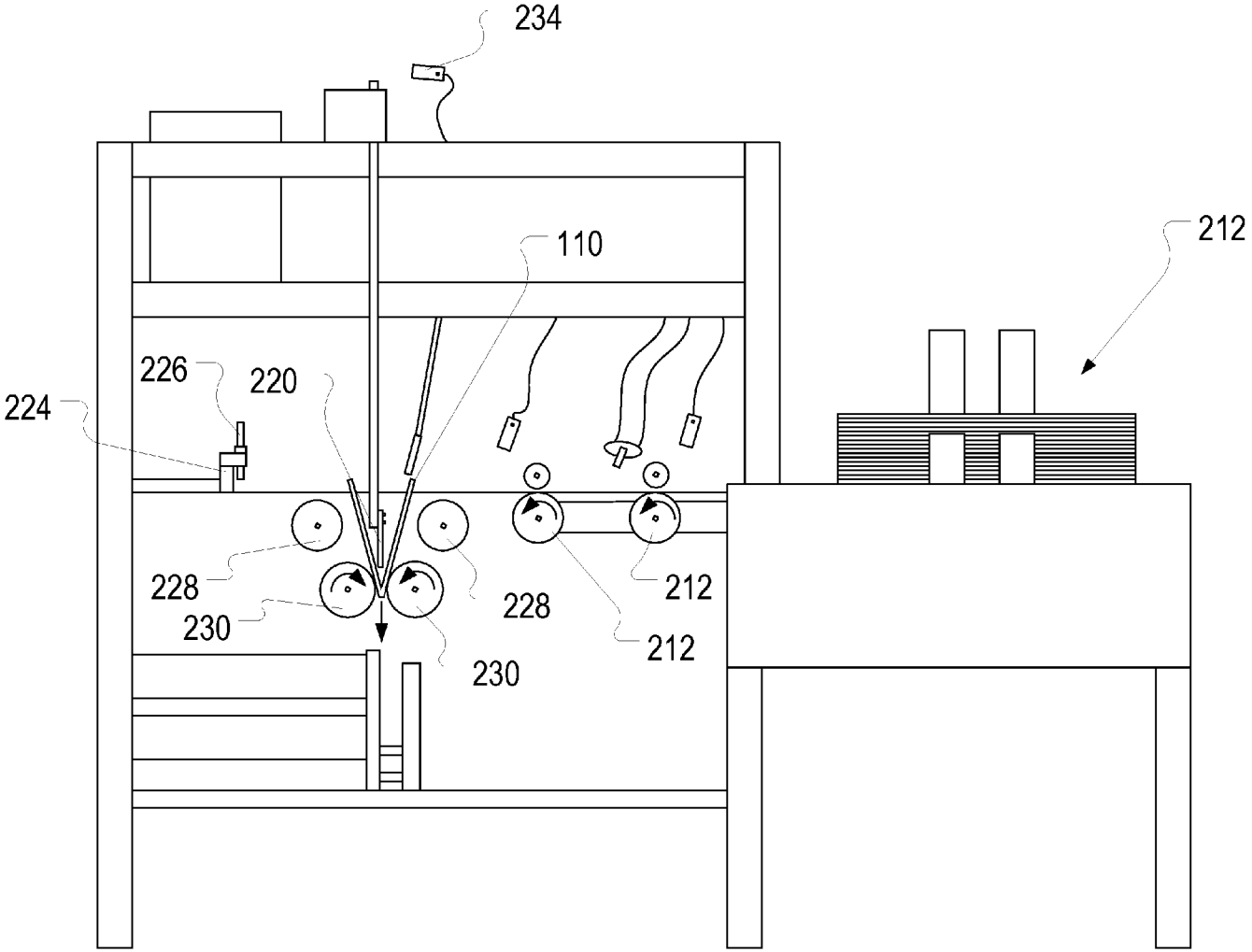
Figure 27A:
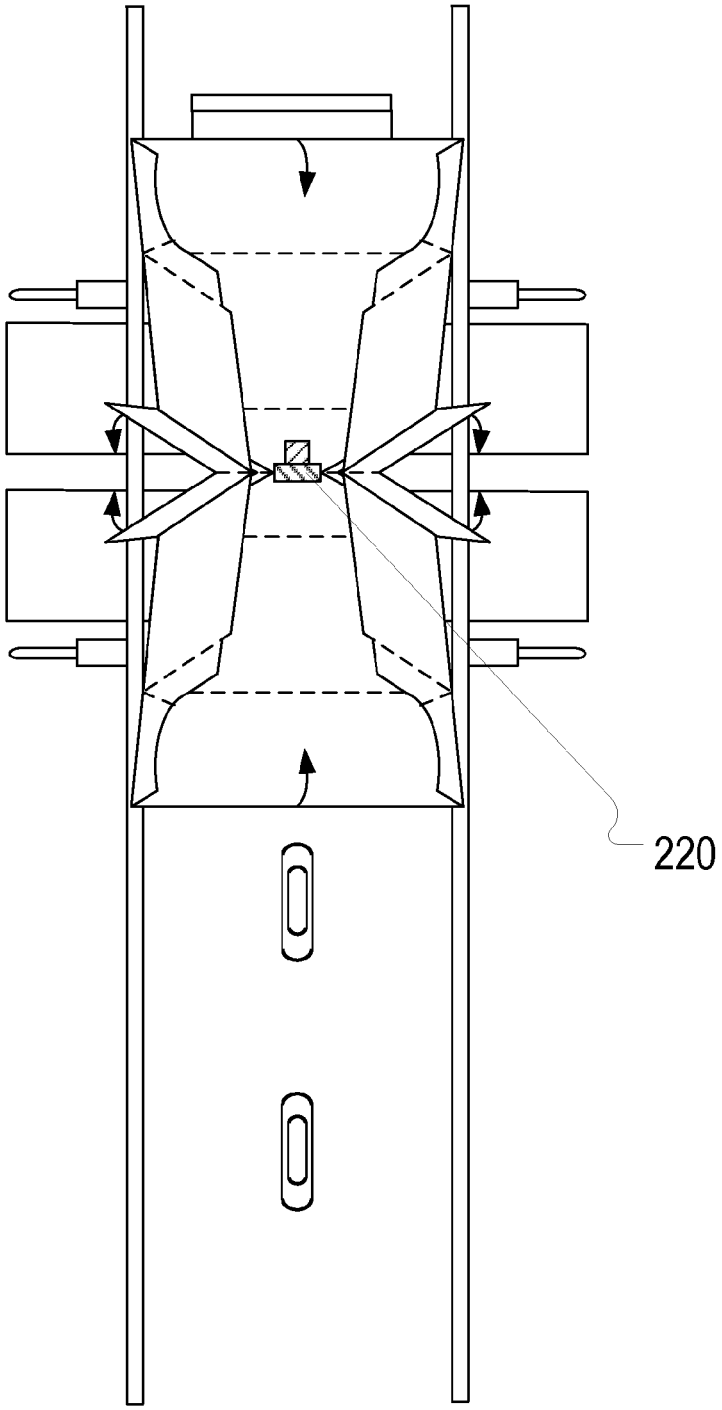
Figure 27B:
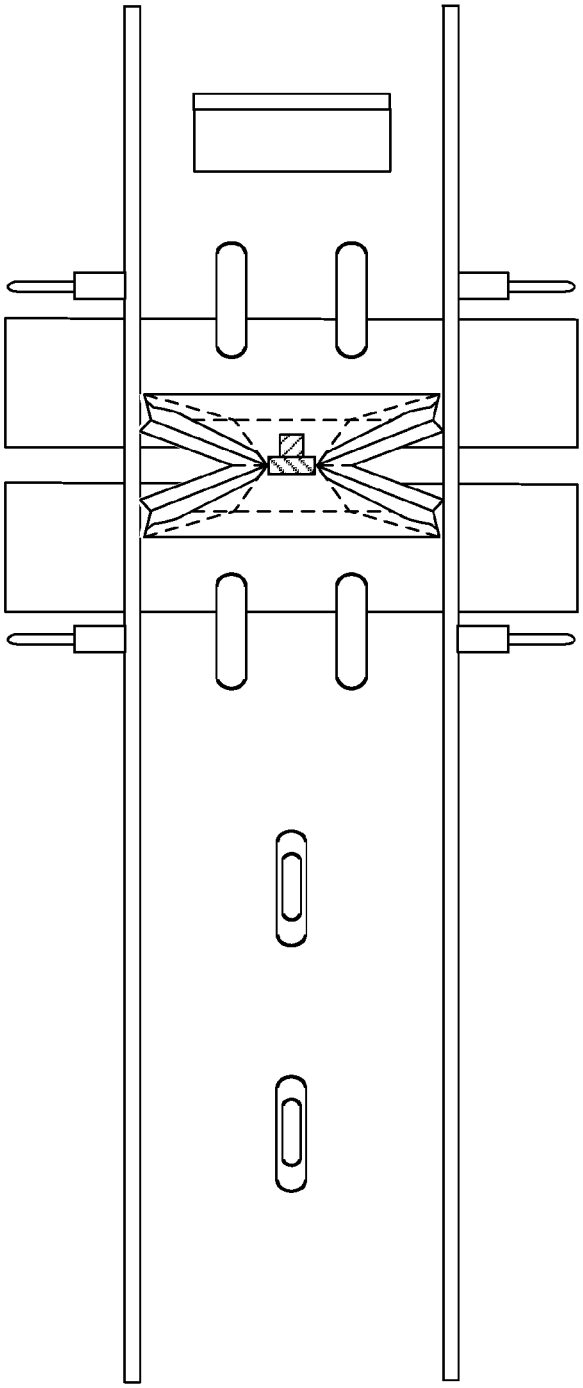

As the box cutout 110 descends, it is guided by opposed freely rotating guide wheels 228, as illustrated in FIG. 26A. As the box cutout 202 continues to descend, it comes into contact with drive wheels 230 that are configured to "grab" the box cutout 110, pull the box cutout 110 from the plunger, and propel it downward. Accordingly, the drive wheels 230 can be characterized as grab wheels 230. The drive wheels 230 further press the box cutout 110 together as it passes between the drive wheels 230, as illustrated in FIG. 26B. Two sets of opposed drive wheels are illustrated; however, additional drive wheel sets may be utilized, with the drive wheel arrangement including opposed drive wheels generally stacked in a converging "v" formation.

Figure 28:
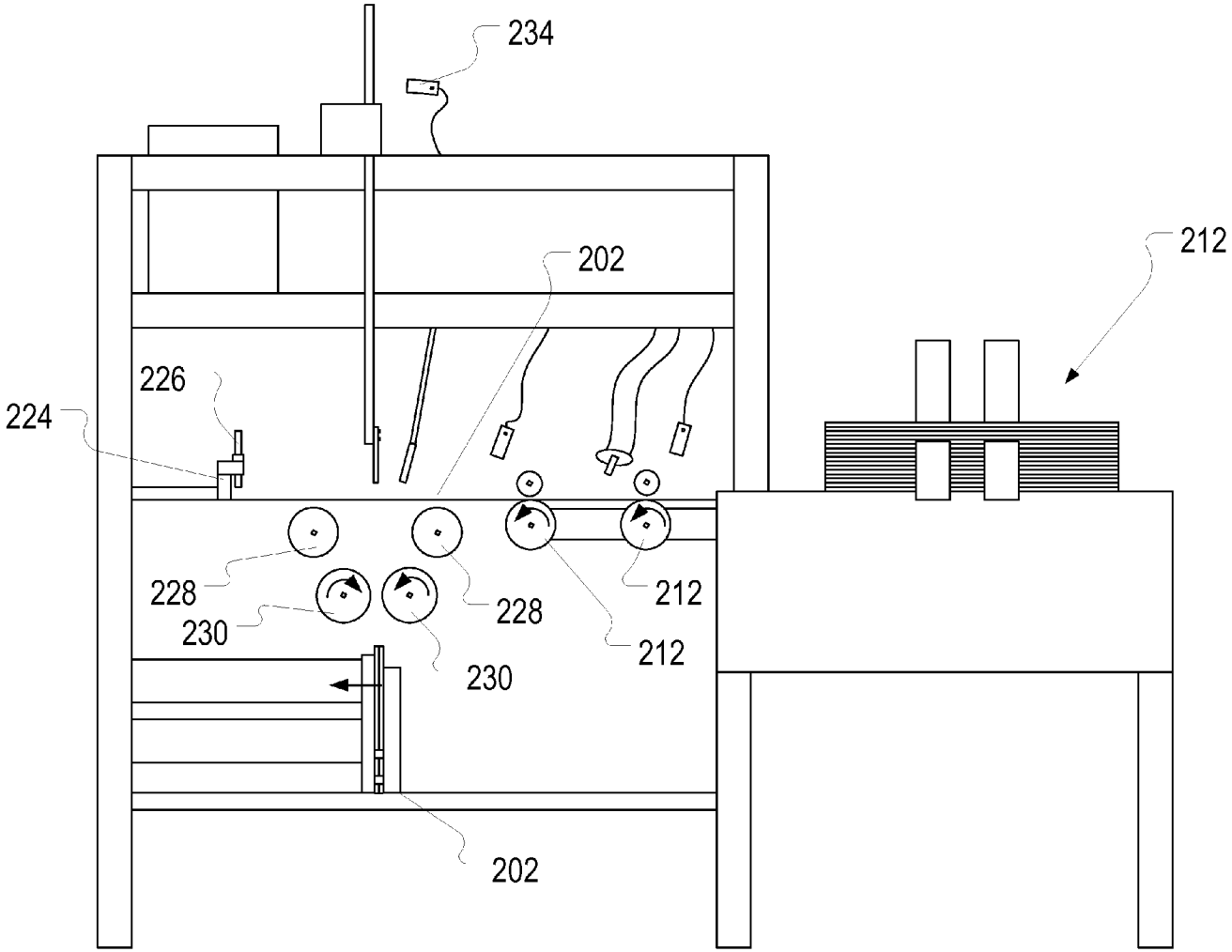

Thereafter, the collapsed box cutout 110 is deposited into a collection area where a collector 242 pushes the collapsed box cutout 110 into a collection pen 240, as illustrated in FIG. 28. As box cutouts 110 are processed by the machine 210, they are collected in the collection pen 240.

Figure 29:
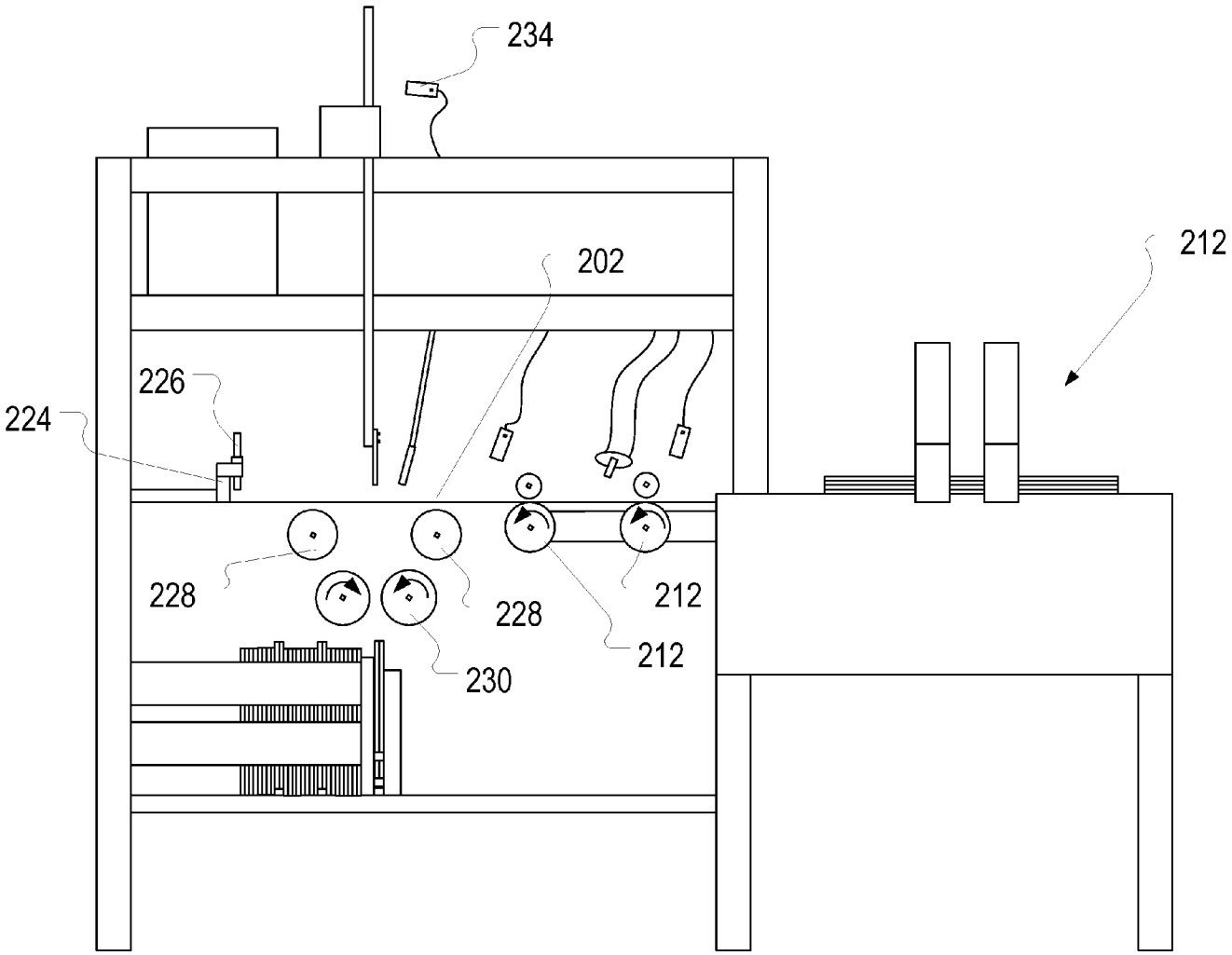

Preferably, the machine 210 includes a third laser detector 234 disposed proximate a portion of a plunging mechanism for driving the plunger 220. The third laser detector 234 is configured to detect each plunge of the plunger 220, and thus keep track of a number of box cutouts 202 processed by the machine 210. The collection area and/or the collector 242 preferably includes an indexing mechanism 240 which functions to elevate certain ones of the box cutouts 110 collected in the collection pen 240. For example, the indexing mechanism 240 might be configured to, based on detection of plunges by the laser detector 234, elevate one out of every five collected box cutouts 110, as illustrated in FIG. 29. In a preferred implementation, the machine 210 is configured such that the indexing mechanism 240 elevates one out of every fifteen collected box cutouts 110.

Indexing of box cutouts 110 facilitates easy removal of a precise number of box cutouts 110 from the collection pen 240 in a precise manner. For example, a certain number of box cutouts 110 can be removed and themselves packed in an non-collapsed box cutout 110 itself disposed in an expanded box configuration for use.

Although described hereinabove with respect to box cutout 110, it will be appreciated that machine 210, or other similar machines, may equally be configured for different sized and shaped box cutouts.

In one or more preferred implementations, one or more of the drive wheels 212 are adjustable so as to allow the machine 210 to be configured for different sized box cutouts.

Figure 30:
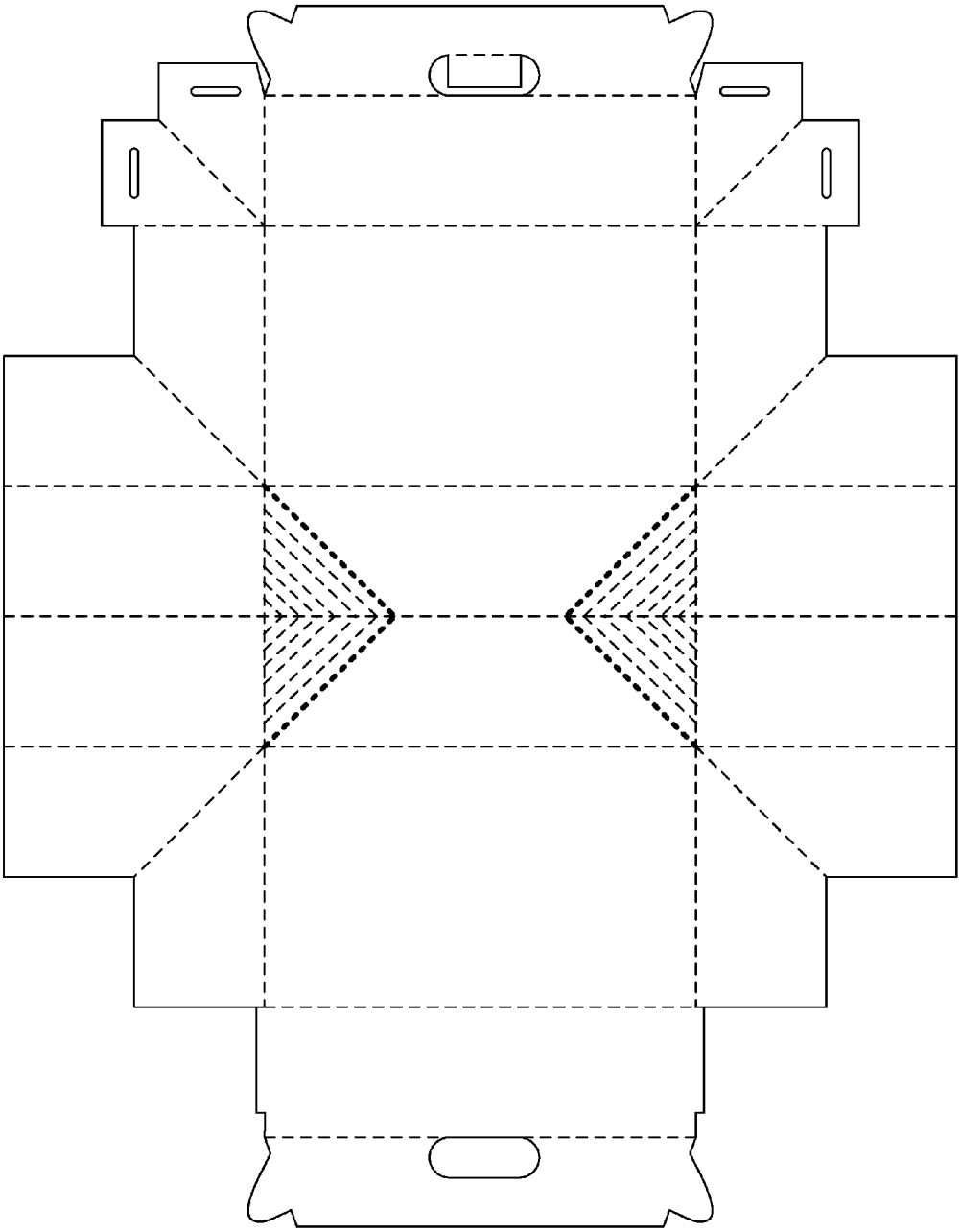
FIG. 30 illustrates a top plan view of an exemplary box cutout suitable for use as a disposable ice chest.

In a preferred implementation, a machine is configured for box cutouts intended to function as disposable coolers, such as those disclosed in the provisional patent application 61/452,640, incorporated herein by reference. FIG. 30 illustrates an exemplary box cutout 310 suitable for use as a disposable cooler.

In at least some implementations, rotational fingers are not utilized to effect folding of a box cutout prior to plunging. For instance, in an alternative the use of fixed fingers or other fixed physical objects are positioned so as to be engaged by the box cutout during plunging, thereby resulting in manipulation of the box in certain predefined manners. In yet another alternative, both rotational fingers and fixed fingers are utilized.

Figure 31:
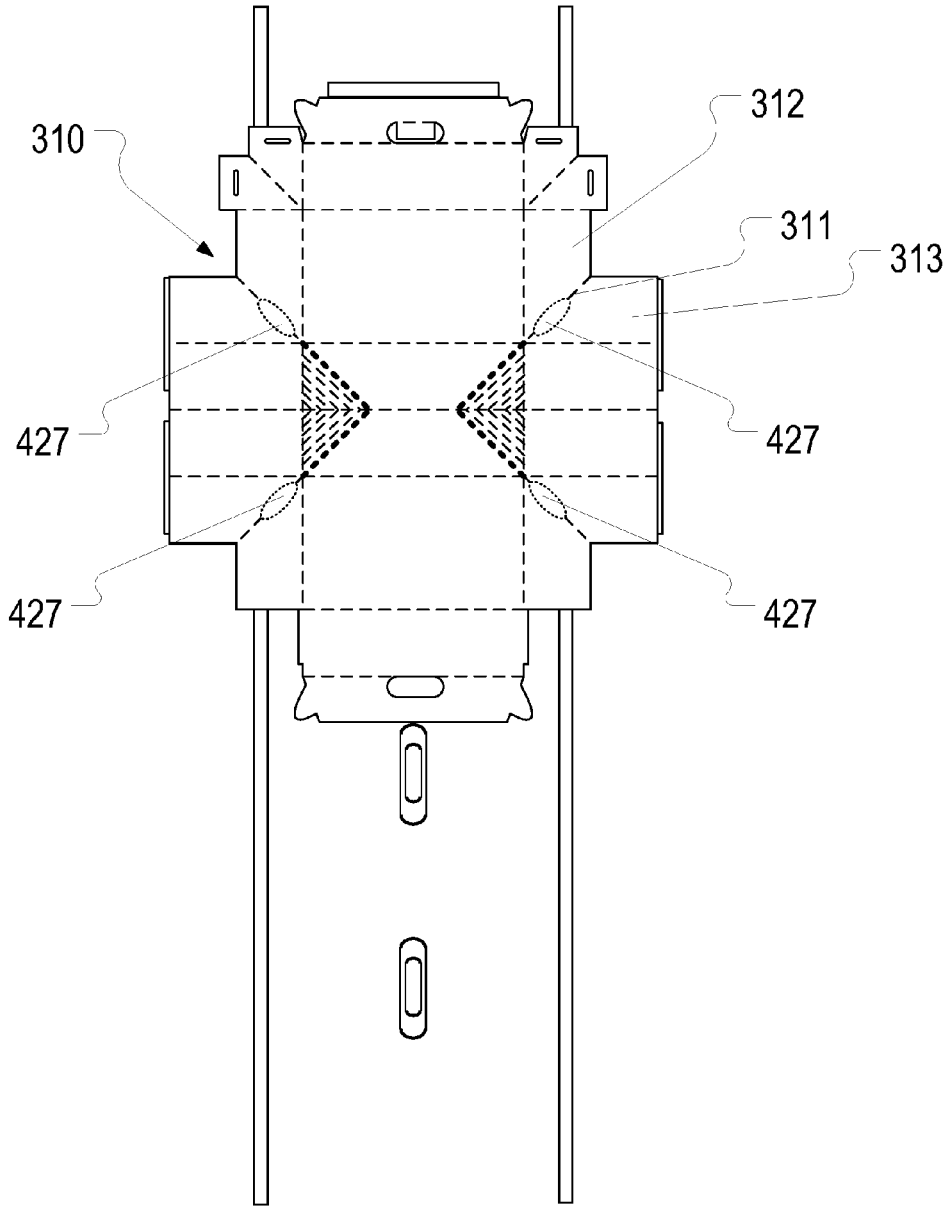
FIGS. 31-32 illustrate components of a machine and manufacturing method in accordance with one or more other preferred embodiments of the invention.
Figure 32:
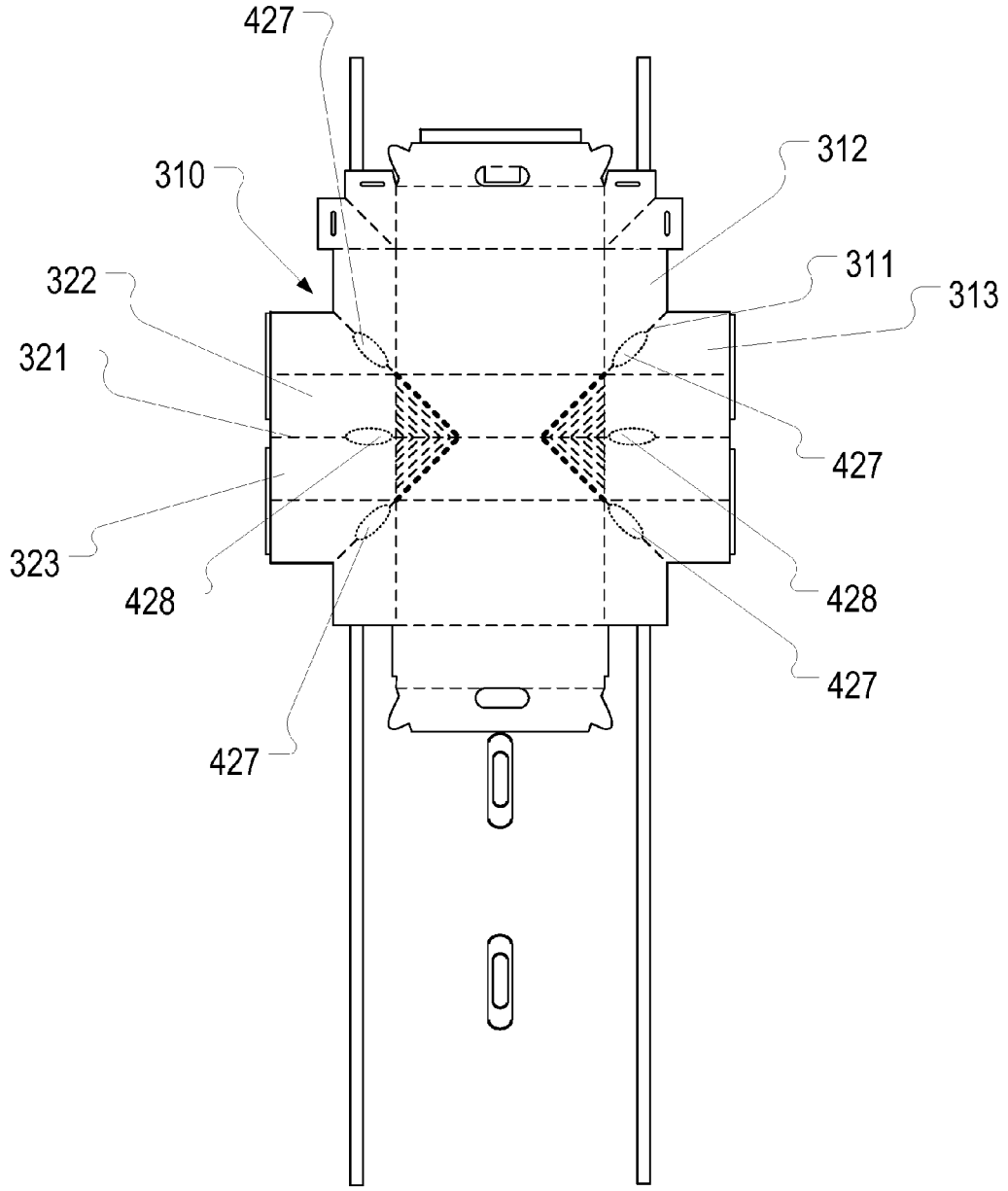

FIG. 31 illustrates positioning of fixed fingers 427 in the machine 210 so as to effect automatic folding inward of panels 312,313 of a cutout 310 along score lines 311 during plunging of the cutout 310 (the fingers 427 are illustrated with broken lines to indicate that they are located below the box cutout 310). Additional fixed fingers may be utilized to further facilitate folding, such as, for example, fixed fingers 428 illustrated in FIG. 32, which facilitate folding inward of the panels 322,323 of the box cutout 310 along score lines 321 during plunging of the cutout 310.

In some preferred implementations, fixed fingers are positioned at a forty-five degree angle relative to a vertical plane. Additionally, or alternatively, fixed fingers may be disposed at a forty-five degree angle relative to a horizontal plane. In at least some implementations, although described as "fixed", fixed fingers are adjustable through one or more planes but, during operations of the machine following any such setup of the machine, the fixed fingers remain stationary.

It is believed that the use of such fixed fingers or other fixed structures to enable folding during plunging results in increased product rates because any momentary pause, however, short, that is required for flippers to actuate is obviated.

In some implementations, a machine includes glue applicators configured to apply glue to both top and bottom (inner and outer) sides of a box cutout. For example, with respect to a cutout 3101, a machine is preferably configured to apply glue to the inner side of the panels 322 and/or the panels 313 to secure such panels together when plunged; to the outer side of the panels 312 and/or the panels 313 to secure such panels together when plunged; and to the outer side of the panels 322,323 to secure such panels together when plunged.

The Appendix, which is incorporated herein by reference, includes photographs of an exemplary machine in accordance with one or more preferred embodiments of the present invention. In use, the machine has been observed to make box cutouts in the collapsed configuration as represented in FIG. 15 at speeds as great as 1.2 boxes per second. That is, the machine has transitioned flat box cutouts to fully formed but collapsed box configurations at speeds of up to 72 boxes per minute. This is believed to be approximately twice the speed achievable utilizing a tray forming machine to form similar boxes.

Although described hereinabove in the context of a machine configured for transitioning of a single box cutout at a time, e.g. machines having a single plunger for plunging of a single box cutout at a time, in one or more preferred implementations a machine is configured with two or more plungers for simultaneous plunging of two or more box cutouts. In some implementations, collapsed box cutouts may then be collected in different collection areas, while in other implementations, all such box cutouts may be collected in a single collection area.

Although description herein largely focuses on box cutouts, systems, methods, and apparatus described herein could equally be utilized in other contexts, including other packaging contexts. For example, innovations described herein could equally be utilized in the context of cartons having non-corrugated walls.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention. Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A machine configured to transition a box cutout from a flat unfolded configuration to a collapsed folded box configuration, the machine comprising:

(a) one or more drive wheels configured to drive a box cutout towards a plunging area;

(b) one or more freely rotating wheels, each freely rotating wheel being disposed directly opposite to one of the one or more first drive wheels;

(c) one or more glue applicators configured to apply glue to the box cutout;

(d) a first detector configured to detect the presence of the box cutout and trigger application of glue thereto;

(e) a backstop configured to halt movement of the box cutout in the plunging area;

(f) one or more rotational fingers configured to effect folding of the box cutout disposed in the plunging area;

(g) one or more clamps configured to hold the box cutout in position during folding by the one or more rotational fingers;

(h) a plunger located in the plunging area configured to apply force to a central portion of the box cutout disposed below the plunger so as to effect, (1) at least partial collapsing of the box cutout, and (2) downward movement of the box cutout;

(i) a second detector configured to detect the presence of the box cutout and trigger folding thereof by the one or more rotational fingers and plunging thereof by the plunger;

(j) one or more guide wheels located below the plunging area, the guide wheels being configured to engage the box cutout being plunged by the plunger;

(k) opposed grab wheels located below the one or more guide wheels, the grab wheels being configured to engage the box cutout that has been plunged downward by the plunger, facilitate collapse of the box cutout, and propel the box cutout further downward; and (l) a collector configured to collect the box cutout propelled downward by the grab wheels and place such collected box cutout in a collection pen;

(m) wherein the backstop and one of the drive wheels are each positioned relative to the plunger based on dimensions of the particular box cutout being constructed; and (n) wherein a length of a plunging head of the plunger corresponds to the length of a portion of a score line of the particular box cutout.

2. The machine of claim 1, wherein the machine further includes a third detector configured to detect plunging of the plunger, and wherein the collector is configured to, based on a count of plunges detected by the third detector, elevate a particular collected box cutout when placing that particular collected box cutout in the collection pen.

3. The machine of claim 1, wherein the one or more drive wheels comprise two drive wheels.

4. The machine of claim 1, wherein the one or more guide wheels comprise two opposed sets of two guide wheels.

5. The machine of claim 1, wherein the grab wheels are configured to press together opposite sides of a box cutout passing therebetween.

6. The machine of claim 1, wherein the machine further includes a cutout receiving area configured to receive a plurality of box cutouts for processing by the machine.

7. The machine of claim 1, wherein the one or more glue applicators include one or more first glue applicators configured to apply glue to a top side of a box cutout and one or more second glue applicators configured to apply glue to a bottom side of a box cutout.

8. The machine of claim 1, wherein each detector comprises a laser detector.

9. The machine of claim 1, wherein the plunging head of the plunger has a blunt end.

10. The machine of claim 1, wherein the plunging head of the plunger is tapered.

11. The machine of claim 1, wherein the plunging head of the plunger has a planar face configured to engage a box cutout.

12. The machine of claim 1, wherein the plunging head of the plunger has a curved face configured to engage a box cutout.

13. The machine of claim 1, wherein the plunging head of the plunger is configured to be removable and interchangeable with other plunging heads.

14. The machine of claim 1, wherein the machine further includes a deflector disposed adjacent the plunger, the deflector being shaped and positioned to deflect a box cutout downward in the event that such a box cutout has drifted upward.

15. The machine of claim 1, wherein a position of the backstop is adjustable; a position of at least one of the drive wheels and the guide wheels is adjustable; a position of at least one of the one or more glue applicators is adjustable; and a distance the plunger plunges is adjustable.

16. The machine of claim 1, wherein a position of each of the one or more rotational fingers is adjustable.

17. A machine configured to transition a box cutout from a flat unfolded configuration to a collapsed folded box configuration, the machine comprising:

(a) a backstop configured to halt forward movement of a box cutout in a plunging area;

(b) one or more rotational fingers configured to effect folding of a box cutout disposed in the plunging area;

(c) a plunger configured to apply force to a central portion of a box cutout disposed below the plunger so as to effect (1) at least partial collapsing of that box cutout and (2) downward movement of that box cutout, the plunger comprising a plunging head configured to engage such a box cutout;

(d) a detector configured to detect the presence of a box cutout and trigger folding thereof by the one or more rotational fingers and plunging thereof by the plunger; and (e) opposed grab wheels located below the plunging area, the grab wheels being configured to engage a box cutout that has been plunged downward by the plunger, facilitate collapse of such box cutout, and propel such box cutout further downward;

(f) wherein the backstop is positioned relative to the plunger based on dimensions of a particular box cutout; and (g) wherein a length of the plunging head of the plunger corresponds to the length of a portion of a score line of the particular box cutout.

18. The machine of claim 17, wherein the box cutout is folded into a collapsed folded box configuration from the flat unfolded configuration upon application of the force by the plunger.

19. A machine configured to transition a box cutout from a flat unfolded configuration to a collapsed folded box configuration, the machine comprising:

(a) one or more drive wheels configured to drive a box cutout towards a plunging area;

(b) one or more freely rotating wheels, each freely rotating wheel being disposed directly opposite to one of the one or more first drive wheels;

(c) one or more glue applicators configured to apply glue to the box cutout;

(d) a first detector configured to detect the presence of the box cutout and trigger application of glue thereto;

(e) a backstop configured to halt movement of the box cutout in the plunging area;

(f) one or more rotational fingers configured to effect folding of the box cutout disposed in the plunging area;

(g) one or more clamps configured to hold the box cutout in position during folding by the one or more rotational fingers;

(h) a plunger located in the plunging area configured to apply force to a central portion of the box cutout disposed below the plunger so as to effect at least partial collapsing and downward movement of the box cutout;

(i) a second detector configured to detect the presence of the box cutout and trigger folding thereof by the one or more rotational fingers and plunging thereof by the plunger;

(j) one or more guide wheels located below the plunging area, the guide wheels being configured to engage the box cutout being plunged by the plunger;

(k) opposed grab wheels located below the one or more guide wheels, the grab wheels being configured to engage the box cutout that has been plunged downward by the plunger, facilitate collapse of the box cutout, and propel the box cutout further downward; and (l) a collector configured to collect the box cutout propelled downward by the grab wheels and place such collected box cutout in a collection pen;

(m) wherein the backstop and one of the drive wheels are each positioned relative to the plunger based on dimensions of the particular box cutout being constructed;

(n) wherein a length of a plunging head of the plunger corresponds to the length of a portion of a score line of the particular box cutout;

(o) wherein the machine further includes a cutout receiving area configured to receive a plurality of box cutouts for processing by the machine; and (p) wherein the machine further includes a deflector disposed adjacent the plunger, the deflector being shaped and positioned to deflect a box cutout downward.

20. The machine of claim 19, wherein the one or more glue applicators include one or more first glue applicators configured to apply glue to a top side of a box cutout and one or more second glue applicators configured to apply glue to a bottom side of a box cutout.

* * * * *